US008702225B2

(12) United States Patent
Kachi et al.

(10) Patent No.: US 8,702,225 B2
(45) Date of Patent: Apr. 22, 2014

(54) INKJET RECORDING APPARATUS AND IMAGE FORMING METHOD

(75) Inventors: Yasuhiko Kachi, Kanagawa (JP); Kazuo Sanada, Kanagawa (JP); Hirofumi Saita, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 83 days.

(21) Appl. No.: 13/293,939

(22) Filed: Nov. 10, 2011

(65) Prior Publication Data

US 2012/0120168 A1 May 17, 2012

(30) Foreign Application Priority Data

Nov. 11, 2010 (JP) ..... 2010-253185

(51) Int. Cl.
*B41J 2/01* (2006.01)

(52) U.S. Cl.
USPC ..... 347/102

(58) Field of Classification Search
USPC ..... 347/5, 12–14, 17, 19, 40–43, 95, 96, 347/100–102, 107
IPC ..... B41J 2/01
See application file for complete search history.

(56) References Cited

U.S. PATENT DOCUMENTS

| | | | | |
|---|---|---|---|---|
| 5,844,585 | A | 12/1998 | Kurashima et al. | |
| 7,600,867 | B2 | 10/2009 | Mills et al. | |
| 2003/0035037 | A1 | 2/2003 | Mills et al. | |
| 2005/0237352 | A1 * | 10/2005 | Yoneyama | 347/9 |
| 2008/0225100 | A1 | 9/2008 | Kumagi | |
| 2009/0167794 | A1 * | 7/2009 | Hosono et al. | 347/6 |
| 2009/0244157 | A1 | 10/2009 | Hishida et al. | |
| 2009/0244230 | A1 * | 10/2009 | Ohnishi et al. | 347/102 |
| 2010/0182378 | A1 | 7/2010 | Mitsuzawa | |
| 2011/0310204 | A1 | 12/2011 | Ohnishi | |

FOREIGN PATENT DOCUMENTS

| | | | |
|---|---|---|---|
| EP | 2 095 966 | A1 | 9/2009 |
| EP | 2 095 968 | A1 | 9/2009 |
| JP | 2002-011860 | A | 1/2002 |
| JP | 2003-136697 | A | 5/2003 |
| JP | 2004-306617 | A | 11/2004 |
| JP | 2005-219401 | A | 8/2005 |
| JP | 2006-150633 | A | 6/2006 |
| JP | 2007-118409 | A | 5/2007 |
| JP | 2009-051095 | A | 3/2009 |
| JP | 2009-113284 | A | 5/2009 |
| JP | 2009-126071 | A | 6/2009 |
| JP | 2009-208227 | A | 9/2009 |
| JP | 2009-208228 | A | 9/2009 |
| JP | 2009-226622 | A | 10/2009 |
| JP | 2010-167678 | A | 8/2010 |
| JP | 2010-195002 | A | 8/2010 |
| JP | 2010-241048 | A | 10/2010 |
| WO | WO 2005/105452 | A1 | 10/2005 |

* cited by examiner

*Primary Examiner* — Manish S Shah
*Assistant Examiner* — Roger W Pisha, II
(74) *Attorney, Agent, or Firm* — Birch, Stewart, Kolasch & Birch, LLP

(57) ABSTRACT

An inkjet recording apparatus and an image forming method in which ink curing defects caused by differences in the activation energy absorption characteristics due to differences in the inks are avoided, and a desirable curing process can be achieved.

19 Claims, 26 Drawing Sheets

INKJET RECORDING APPARATUS AND IMAGE FORMING METHOD

BACKGROUND OF THE INVENTION

1. Field of the Invention

The present invention relates to an inkjet recording apparatus and an image forming method, and more particularly, to an image forming technology using ultraviolet-curable ink.

2. Description of the Related Art

Conventionally, an inkjet recording apparatus which forms a desired image on a recording medium by ejecting color ink from an inkjet head is known as a general image forming apparatus. In recent years, non-permeable (low-permeability) media such as resin film have been used, in addition to media having permeability, such as paper, and apparatuses which cure ink deposited on a medium by irradiating ultraviolet light as active light have been proposed. The ultraviolet-curable ink used in this apparatus contains a photoinitiator having prescribed sensitivity with respect to ultraviolet light.

In an inkjet recording apparatus which uses ultraviolet-curable ink, a light source for irradiating ultraviolet light is mounted on a carriage on which an inkjet head is installed, the ultraviolet light source is scanned (moved) so as to follow the inkjet head, and ultraviolet light is irradiated onto ink droplets immediately after landing on a medium, thereby preventing positional displacement of the ink droplets.

U.S. Pat. No. 7,600,867 discloses an ultraviolet-curing type of print system in which curing light sources arranged on either side in the main scanning direction of an inkjet head are composed movably on the downstream side of the conveyance direction of the recording medium. The print system described in U.S. Pat. No. 7,600,867 semi-cures ink droplets by irradiating ultraviolet light of a low amount immediately after landing of the ink droplets, and after a prescribed period of time has elapsed, moves the curing light source to the downstream side of the inkjet head in terms of the conveyance direction of the recording medium and then performs main curing of the ink droplets by irradiating ultraviolet light of a high amount.

However, in image formation in which layers of color ink, a layer of white ink and a layer of clear (transparent) ink are superimposed on each other on a recording medium, the activation energy absorption characteristics (ink curing characteristics) vary with differences in the inks, and therefore curing defects due to insufficient activation energy and image defects due to excessive activation energy may occur.

The print system described in U.S. Pat. No. 7,600,867 varies the amount of light in provisional curing and main curing, but the amount of light irradiated onto all of the inks is uniform. In other words, in image formation in which layers of color inks and a layer of white ink or clear ink are stacked together, it is difficult to resolve the aforementioned problems caused by differences in the ultraviolet light absorption characteristics of the respective inks.

SUMMARY OF THE INVENTION

The present invention has been contrived in view of these circumstances, an object thereof being to provide an inkjet recording apparatus and an image forming method in which ink curing defects caused by differences in the activation energy absorption characteristics due to differences in the inks are avoided, and a desirable curing process can be achieved.

In order to achieve an aforementioned object, one aspect of the invention is directed to an inkjet recording apparatus comprising: an image forming device including nozzle rows which are provided to correspond to inks that are curable by irradiation of an active light beam and have different curing characteristics respectively, and which have nozzles arranged for ejecting the inks; a relative movement device which causes relative movement between the nozzle rows and a recording medium on which the inks ejected from the nozzles are deposited; an ejection control device which controls ink ejection from the image forming device with respect to each of divided units obtained by dividing the nozzle rows into a plurality of units, so as to form layers on the recording medium by the inks ejected from the respective divided units in such a manner that the layers that are formed by the inks ejected from the different divided units are superimposed on each other; an active light beam irradiation device which irradiates the active light beam onto the inks that have been ejected onto the recording medium; and an irradiation light amount variation device which is capable of varying an amount of irradiation light from the active light beam irradiation device, in accordance with the curing characteristics of the inks in the respective layers on the recording medium.

Another aspect of the invention is directed to an image forming method comprising:

an ink ejection step of ejecting inks which are curable by irradiation of an active light beam with respect to each of units obtained by dividing a nozzle row in which nozzles are arranged into units while causing relative movement between the nozzle row and a recording medium, the inks with different curing characteristics being ejected from different nozzle rows so as to form layers on the recording medium by the inks ejected from the divided units of the nozzle rows in such a manner that the layers formed by the inks ejected from different divided units are mutually superimposed; and an active light beam irradiation step of adjusting an irradiation light amount from the active light beam irradiation device in accordance with the curing characteristics of the inks constituting the layers formed on the recording medium.

According to the present invention, since the irradiation light amount of an active light beam is varied for respective inks in accordance with differences in the curing characteristics of the inks (active light beam absorption characteristics), then it is possible to to obtain a desirable curing state for each ink, and a layer formed by ink which has relatively high sensitivity to the active light beam and has a fast curing speed and a layer formed by ink which has relatively low sensitivity to the active light beam and has a slow curing speed can be superimposed on each other.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

First Embodiment

[General Composition of Inkjet Recording Apparatus]

Figure 1:
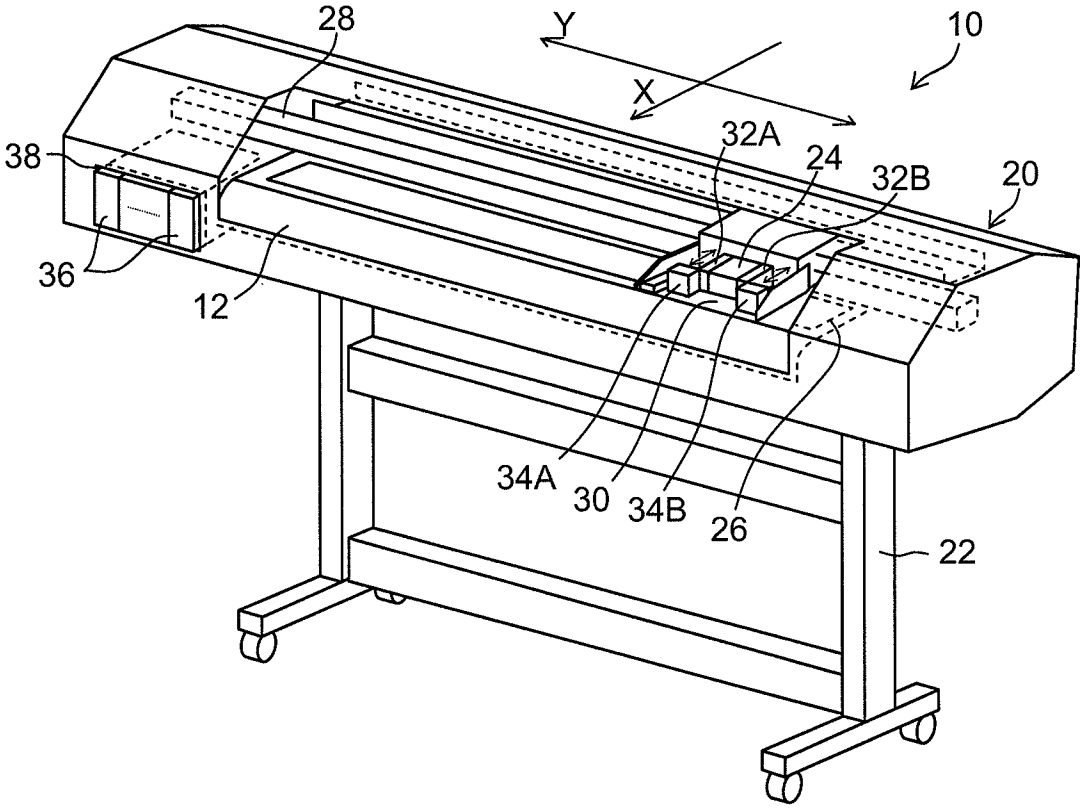
FIG. 1 is an external perspective drawing of an inkjet recording apparatus relating to a first embodiment of the present invention.

FIG. 1 is an external perspective drawing of an inkjet recording apparatus relating to a first embodiment of the present invention. This inkjet recording apparatus 10 is a wide-format printer which forms a color image on a recording medium 12 by using ultraviolet-curable ink (UV-curable ink). A wide-format printer is an apparatus which is suitable for recording a wide image formation range, such as for large posters or commercial wall advertisements, or the like. Here, a printer corresponding to a medium having a size of A3 with a predetermined margin or greater is called "wide-format".

The inkjet recording apparatus 10 includes an apparatus main body 20 and a stand 22 which supports the apparatus main body 20. The apparatus main body 20 includes a drop-on-demand type of inkjet head 24 which ejects ink toward a recording medium (medium) 12, a platen 26 which supports the recording medium 12, and a guide mechanism 28 and a carriage 30 which function as a head movement device (scanning means).

The guide mechanism 28 is disposed so as to extend above the platen 26, following the scanning direction (Y direction) which is parallel to the medium supporting surface of the platen 26 and which is perpendicular to the conveyance direction (X direction) of the recording medium 12. The carriage 30 is supported so as to be able to perform reciprocal movement in the Y direction along a guide mechanism 28. The inkjet head 24 is mounted on the carriage 30, and provisional curing light sources (pinning light sources) 32A, 32B, and main curing light sources (curing light sources) 34A, 34B which irradiate ultraviolet light onto the ink after the recording medium 12 are also mounted on the carriage 30.

The provisional curing light sources 32A, 32B are light sources which irradiate ultraviolet light for provisionally curing the ink to an extent whereby adjacent droplets do not combine together after ink droplets ejected from the inkjet head 24 have landed on the recording medium 12. The main curing light sources 34A, 34B are light sources which perform additional exposure after provisional curing and which irradiate ultraviolet light for finally curing the ink completely (main curing). As described in detail below, either one of the main curing light sources 34A, 34B is composed movably in the X direction, so as to be aligned in the Y direction with the inkjet head 24 and the provisional curing light sources 32A, 32B.

The inkjet head 24, the provisional curing light sources 32A, 32B and the main curing light sources 34A, 34B disposed on the carriage 30 move in unison with (together with) the carriage 30 along the guide mechanism 28. The reciprocal movement direction (Y direction) of the carriage 30 may be called the "main scanning direction" and the conveyance direction (X direction) of the recording medium 12 may be called the "sub-scanning direction".

Various media may be used for the recording medium 12, without any restrictions on the material, such as paper, unwoven cloth, vinyl chloride, compound chemical fibers, polyethylene, polyester, tarpaulin, or the like, or whether the medium is permeable or non-permeable. The recording medium 12 is supplied in a rolled state (see FIG. 2) from the rear surface of the apparatus, and after printing, the medium is rolled onto a take-up roller on the front side of the apparatus (not shown in FIG. 1 and reference numeral 44 in FIG. 2). Ink droplets are ejected from the inkjet head 24 onto the recording medium 12 which is conveyed on the platen 26, and ultraviolet light is irradiated from the provisional curing light sources 32A, 32B and the main curing light sources 34A, 34B onto ink droplets which have been deposited onto the recording medium 12.

In FIG. 1, the installation section 38 of ink cartridges 36 is provided on the left-side front face of the apparatus main body 20 when the apparatus is viewed from the front. The ink cartridges 36 are replaceable ink supply sources (ink tanks) which store ultraviolet-curable ink. The ink cartridges 36 are provided so as to correspond to respective inks which are used in the inkjet recording apparatus 10 of the present example. The ink cartridges 36 of respective colors are each connected to the inkjet head 24 by ink supply channels (not illustrated) which are formed independently. The ink cartridges 36 are replaced when the amount of remaining ink of the respective colors has become low.

Although not shown in the drawings, a maintenance unit for the inkjet head 24 is provided on the right-hand side of the apparatus main body 20 as viewed from the front side. This maintenance unit includes a cap for keeping the inkjet head 24 moist when not printing, and a wiping member (blade, web, etc.) for cleaning the nozzle surface (ink ejection surface) of the inkjet head 24. The cap which caps the nozzle surface of the inkjet head 24 is provided with an ink receptacle for receiving ink droplets ejected from the nozzles for the purpose of maintenance.

Description of Recording Medium Conveyance Path

Figure 2:
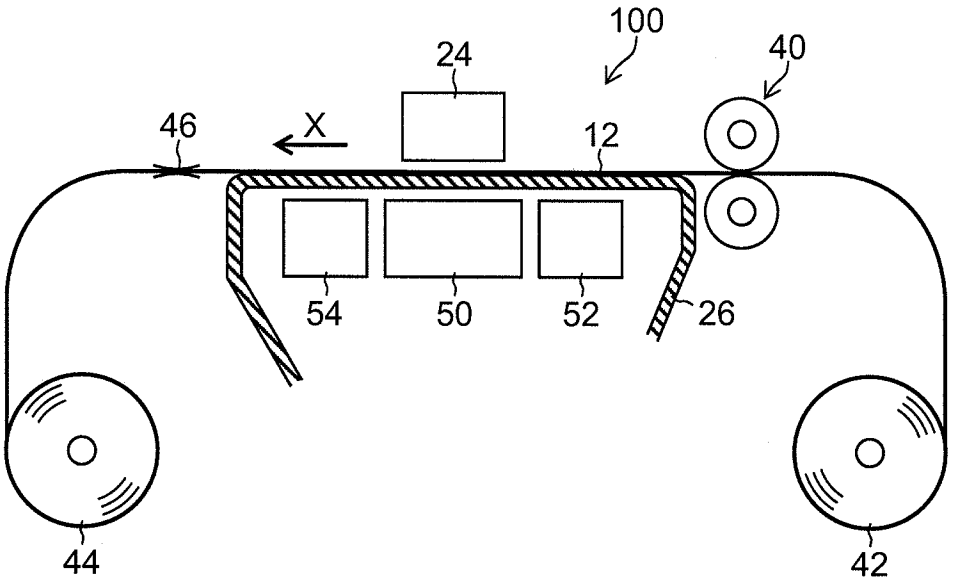
FIG. 2 is an illustrative diagram which shows a schematic drawing of a paper conveyance path in the inkjet recording apparatus shown in FIG. 1.

FIG. 2 is an illustrative diagram showing a schematic view of the recording medium conveyance path in the inkjet recording apparatus 10. As shown in FIG. 2, the platen 26 is formed in an inverted gutter shape and the upper surface thereof serves as a supporting surface (medium supporting surface) for a recording medium 12. A pair of nip rollers 40 which form a recording medium conveyance device for intermittently conveying the recording medium 12 are provided on the upstream side of the platen 26 in the recording medium conveyance direction (X direction), in the vicinity of the platen 26. These nip rollers 40 move the recording medium 12 in the recording medium conveyance direction over the platen 26.

The recording medium 12 which is output from a supply side roll (pay-out supply roll) 42 that constitutes a roll-to-roll type medium conveyance device is conveyed intermittently in the recording medium conveyance direction by the pair of nip rollers 40 which are provided in an inlet opening of the print unit (on the upstream side of the platen 26 in terms of the recording medium conveyance direction). When the recording medium 12 has arrived at the print unit directly below the inkjet head 24, printing is carried out by the inkjet head 24, and the recording medium is then wound up onto a take-up roll 44 after printing. A guide 46 for the recording medium 12 is provided on the downstream side of the print unit in the recording medium conveyance direction.

A temperature adjustment unit 50 for adjusting the temperature of the recording medium 12 during printing is provided on the rear surface (an opposite surface to the surface supporting the recording medium 12) of the platen 26 at a position opposing the inkjet head 24. When the recording medium 12 is adjusted to a prescribed temperature during printing, the viscosity, surface tension, and other physical properties, of the ink droplets deposited onto the recording medium 12, assume prescribed values and it is possible to obtain a desired dot diameter. According to requirements, it is possible to provide a heat pre-adjustment unit 52 on the upstream side of the temperature adjustment unit 50 and to provide a heat after-adjustment unit 54 on the downstream side of the temperature adjustment unit 50.

Description of Inkjet Head

Figure 3:
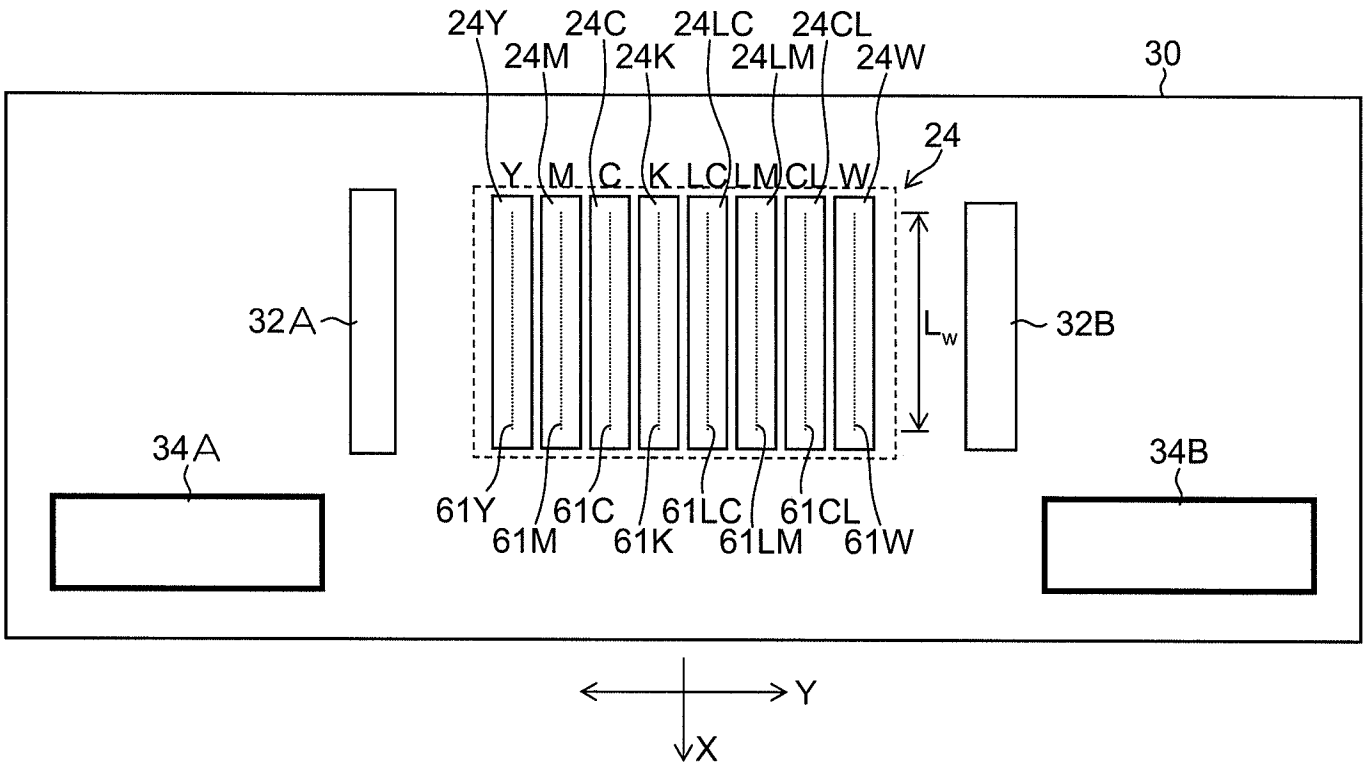
FIG. 3 is a plan view perspective diagram showing an example of the inkjet head shown in FIG. 1.

FIG. 3 is a plan view perspective diagram showing an example of the arrangement of the inkjet head 24, the provisional curing light sources 32A, 32B and the main curing light sources 34A, 34B which are provided on the carriage 30.

Nozzle rows 61Y, 61M, 61C, 61K, 61LC, 61LM, 61CL, 61W are provided in the inkjet head 24 for ejecting inks of the respective colors of yellow (Y), magenta (M), cyan (C), black (K), light cyan (LC), light magenta (LM), clear (transparent) ink (CL) and white ink (W). In FIG. 3, the nozzle rows are indicated by dotted lines, and individual nozzles are not depicted. Furthermore, in the following description, the nozzle rows 61Y, 61M, 61C, 61K, 61LC, 61LM, 61CL and 61W may be referred to generally by the reference numeral 61.

The types of ink color (number of colors) and the combination of colors are not limited to the present embodiment. For example, it is also possible to adopt a mode where the LC and LM nozzle rows are omitted, a mode where the CL and W nozzle rows are omitted, a mode where a nozzle row for metal ink is added, a mode where a nozzle row for metal ink is provided instead of the W nozzle row, or a mode where a nozzle row which ejects ink of a special color is added. Moreover, the arrangement sequence of the nozzle rows of the respective colors is not limited in particular.

An inkjet head 24 capable of color image formation can be composed by forming a head module for the nozzle row 61 of each color and arranging these head modules together. For example, it is possible to adopt a mode in which a head module 24Y having a nozzle row 61Y which ejects yellow ink, a head module 24M having a nozzle row 61M which ejects magenta ink, a head module 24C having a nozzle row 61C which ejects cyan ink, a head module 24K having a nozzle row 61K which ejects black ink, and head modules 24LC, 24LM, 24CL, 24W respectively having nozzle rows 61LC, 61LM 61CL, 61W which eject inks of respective colors of LC, LM, CL and W, are arranged equidistantly in the direction of reciprocal movement of the carriage 30 (the main scanning direction, X direction). The head modules 24Y, 24M, 24C, 24K, 24LC and 24LM of the respective colors can each be interpreted respectively as an "inkjet head". Alternatively, it is also possible to adopt a mode in which the ink flow channels are divided according to color inside one inkjet head 24, and nozzle rows which eject inks of a plurality of colors are provided in one head.

In each of the nozzle rows 61, a plurality of nozzles are arranged in one row (one straight line) in the direction of conveyance of the recording medium (the sub-scanning direction, Y direction) at a uniform interval apart. In the inkjet head 24 according to the present embodiment, the arrangement pitch of the nozzles which make up the nozzle rows 61 (nozzle pitch) is 254 μm (100 dpi), the number of nozzles which constitute one nozzle row 61 is 256 nozzles, and the total length $L_w$ of the nozzle rows 61 (the total length of the nozzle rows) is approximately 65 mm (254 μm×255=64.8 mm) Furthermore, the ejection frequency is 15 kHz, and ejection droplet volumes of three types, 10 pl, 20 pl, 30 pl, can be ejected selectively, by changing the drive waveform.

The ink ejection method of the inkjet head 24 may employ a method which propels ink droplets by deformation of a piezoelectric element (piezo jet method). For the ejection energy generating element, apart from a mode using an electrostatic actuator (electrostatic actuator method), it is also possible to employ a mode which generates air bubbles by heating ink using a heater (heating element) and which propels ink droplets by the pressure of these air bubbles (thermal jet method). However, since the ultraviolet-curable ink generally has a high viscosity compared to solvent ink, it is desirable to employ a piezo jet method which has a relatively large ejection force when using an ultraviolet-curable ink.

Image Formation Mode

The inkjet recording apparatus 10 shown in this embodiment employs multi-pass image formation control, and the print resolution can be varied by changing the number of printing passes. For example, three image formation modes can be used: high-productivity mode, standard mode, high-quality mode, and the print resolution is different among the respective modes. It is possible to select the image formation mode in accordance with the print objective and application.

In high-productivity mode, printing is carried out at a resolution of 600 dpi (main scanning direction)×400 dpi (sub-scanning direction). In high-productivity mode, a resolution of 600 dpi is achieved by two passes (two scanning actions) in the main scanning direction. In the first scan (the outward movement of the carriage 30), dots are formed at a resolution of 300 dpi. In the second scan (return movement), dots are formed so as to be interpolated between the dots formed by the first scan (outward movement), and thus a resolution of 600 dpi is obtained in the main scanning direction.

On the other hand, the nozzle pitch is 100 dpi in the sub-scanning direction, and dots are formed at a resolution of 100 dpi in the sub-scanning direction by one main scanning action (one pass). Consequently, a resolution of 400 dpi is achieved by carrying out interpolated printing by four-pass printing (four scans).

In standard mode, printing is carried out at a resolution of 600 dpi×800 dpi, and this 600 dpi×800 dpi resolution is achieved by means of two pass printing in the main scanning direction and eight pass printing in the sub-scanning direction.

In high-quality mode, printing is carried out at a resolution of 1200×1200 dpi, and this 1200 dpi×1200 dpi resolution is achieved by means of four passes in the main scanning direction and twelve passes in the sub-scanning direction. The main scanning speed of the carriage 30 in high-productivity mode is 1270 mm/sec.

Description of Image Forming Process

The inkjet recording apparatus 10 shown in the present embodiment is composed so as to form an image having a layered structure in which a color image layer formed by color ink (Y, M, C, K, LC, LM, etc.) (indicated by reference numeral 82 in FIG. 5), a transparent layer formed by clear ink (indicated by reference numeral 84 in FIG. 9) and a white base layer formed by white ink (indicated by reference numeral 80 in FIG. 5) are layered on top of each other. Furthermore, the amount of ultraviolet light irradiation is controlled in accordance with the sequence of formation of the layers and the ultraviolet absorption characteristics of the ink (ink curing characteristics).

For example, since white ink includes titanium oxide as a pigment, then the ultraviolet transmissivity thereof is poor compared to color inks and clear ink, and the curing time of the ink is longer when the same amount of ultraviolet light is irradiated per unit volume as the color inks or clear ink. In order to eliminate differences in the curing characteristics caused by the ultraviolet light transmissivity of white link, color inks and clear ink, the irradiation of ultraviolet light is controlled in such a manner that the irradiated amount of ultraviolet light per unit time on the white ink is greater than on the color ink and the clear ink. Specific examples of this image formation are described below.

The K ink is classified as ink which has a long curing time from the viewpoint of ultraviolet light transmissivity, but since interference between ejected droplets is prevented by provisional curing and the dots need to spread, then the K ink is classified as a color ink (more detailed description is given below).

Arrangement of Ultraviolet Light Irradiation Units

As shown in FIG. 3, the provisional curing light sources 32A, 32B are arranged respectively on the left and right-hand sides of the inkjet head 24 in terms of the direction of movement of the carriage (Y direction). Moreover, the main curing light sources 34A, 34B are arranged on the downstream side of the inkjet head 24 in the recording medium conveyance direction (X direction). The main curing light sources 34A, 34B are composed so as to be movable in the direction opposite to the recording medium conveyance direction, and their arrangement can be changed so as to be aligned with the provisional curing light sources 32A, 32B and the inkjet head 24 in the carriage movement direction.

The color ink droplets and clear ink droplets which are ejected from the color ink nozzles (the nozzles included in the nozzle rows 61Y, 61M, 61C, 61K, 61LC, 61LM) and the clear ink nozzles (the nozzles included in the nozzle row 61CL) of the inkjet head 24 and deposited on the recording medium 12 receive irradiation of ultraviolet light for provisional curing by the provisional curing light source 32A (or 32B) which passes thereover immediately after the droplets land on the recording medium.

Furthermore, the ink droplets on the recording medium 12 which has passed through the print region of the inkjet head 24 due to the intermittent conveyance of the recording medium 12 receive irradiation of ultraviolet light for main curing by the main curing light sources 34A, 34B. In this way, by provisionally curing the ink droplets temporarily, it is possible to ensure a dot expansion time (a time during which the dot expands to a prescribed size) while preventing landing interference, and furthermore, a pile height can be achieved (a uniform dot height is achieved).

On the other hand, white ink which is ejected from the white ink nozzles (the nozzles included in the nozzle row 61W) and deposited on the recording medium receives irradiation of ultraviolet light of virtually the same amount as during the main curing process, by the main curing light source 34A which has been moved to an ultraviolet irradiation position corresponding to the ejection position of the white ink.

The white base layer formed by white ink is the underlayer of the color image layers, and therefore does not require a dot resolution as high as the color image layers. Therefore, the white ink does not need to be provisionally cured in order to prevent landing interference or to ensure a dot expansion time. Furthermore, due to the low ultraviolet light transmissivity of the white base layer formed by the white ink, activation energy of substantially the same amount as during the main curing process is applied while the film thickness of the white ink is small (immediately after the white ink lands on the recording medium), thereby carrying out a curing process.

Description of Movement of Main Curing Light Sources

Figure 4:
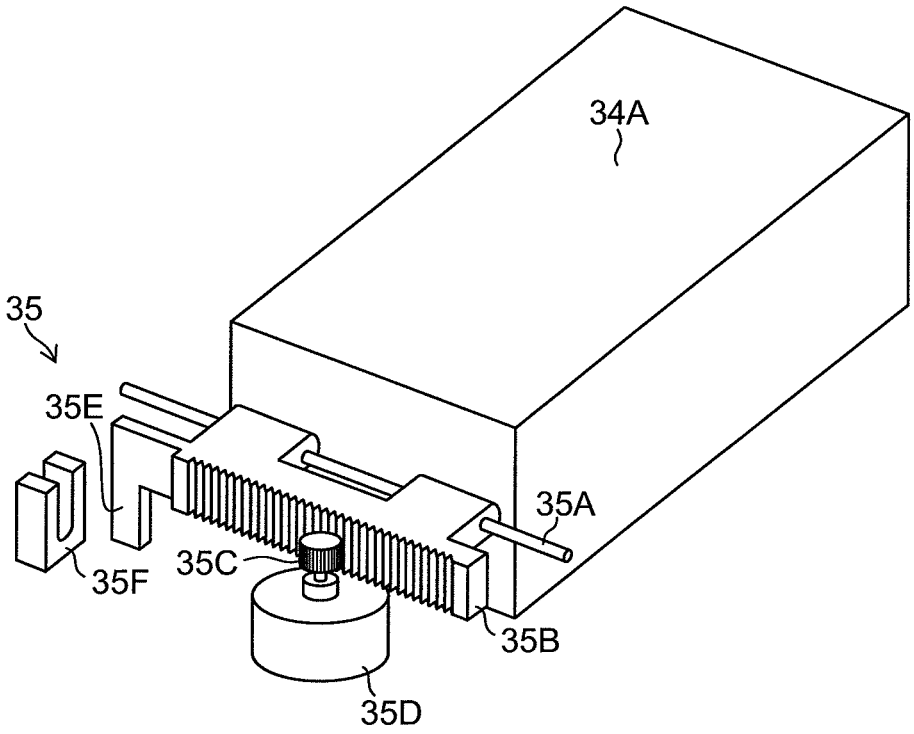
FIG. 4 is a perspective diagram showing an example of the composition of a light source movement unit which moves the ultraviolet light irradiation unit shown in FIG. 3.

FIG. 4 is a perspective diagram showing an example of the composition of a movement mechanism (light source movement unit) 35 for the main curing light source 34A. The light source movement unit 35 shown in FIG. 4 employs a rack-and-pinion type linear movement mechanism. In other words, the light source movement unit 35 includes: a shaft 35A which is fixed along the recording medium conveyance direction which is the direction of movement of the main curing light source 34A; a rack 35B in which tooth-shaped indentations and projections are formed along the shaft 35A and which is installed on a case of the main curing light source 34A; a drive motor 35D having the rotational axle to which a pinion gear 35C is attached; and an optical type position sensor 35F for detecting a detection piece 35E which is formed on the end section of the rack.

When the rotational axle of the drive motor 35D turns, the pinion gear 35C rotates, the rack 35B moves along the shaft 35A due to the pinion gear 35C meshing with the teeth of the rack 35B, and the rack 35B together with the main curing light source 34A move along the shaft 35A. When the detection piece 35E provided on the front end of the rack 35B enters into the detection range of the position sensor 35F, the rotation of the drive motor 35D is halted and the main curing light source 34A halts at a prescribed position.

It is also possible to provide a movement mechanism having a similar composition for the main curing light source 34B which is positioned on the opposite side of the inkjet head 24 from the main curing light source 34A, in such a manner that the main curing light source 34B is movable. Moreover, it is also possible to provide a plurality of position sensors 35F in such a manner that the main curing light source 34A is moved to a plurality of positions.

Detailed Description of Image Forming Process

In the image forming process (image forming method) which is applied in the inkjet recording apparatus 10 according to the present embodiment, the nozzle rows 61 are each divided into a plurality of regions in the recording medium conveyance direction, the color inks, clear ink or white ink are each ejected by using any of the divided regions, and a color image layer, transparent layer and white base layer are formed. The number of divisions of the nozzle rows 61 is the number of image forming layers N.

Furthermore, the recording medium 12 is conveyed intermittently in one direction in units of distance obtained by dividing the length of the divided regions of the nozzle rows 61 in the recording medium conveyance direction by the number of multiple passes ((total length of nozzle row $L_w$/number of image forming layers N)/unit determined by number of multiple passes), in such a manner that layers of ink ejected from a downstream side region of the nozzle rows 61 in the recording medium conveyance direction are layered on top of ink layers ejected from upstream side regions. Here, "the number of multiple passes" is defined as the product of the number of passes in the carriage scanning direction and the number of passes in the recording medium conveyance direction.

Moreover, the white ink which requires more time until curing than the other inks receives irradiation of ultraviolet light of substantially the same amount as during the main curing process, immediately after landing on the recording medium, by either one of the main curing light sources 34A, 34B which are moved to the ejection position of the white ink. The length of the irradiation area in the recording medium conveyance direction of the main curing light sources 34A and 34B is not greater than (total length of nozzle rows $L_w$/number of image forming layers N), in such a manner that ultraviolet light of the same amount as during the main curing process is irradiated only onto the deposition area of the white ink.

In the description given below, the length of the irradiation area of the main curing light sources 34A, 34B in the recording medium conveyance direction and the length of the main curing light sources 34A, 34B in the recording medium conveyance direction are taken to be the same. The actual length of the main curing light sources 34A, 34B in the recording medium conveyance direction is set so as to obtain a prescribed irradiation area by taking account of broadening of the irradiation area. Furthermore, the "number of image forming layers N" may be described as the "number of divisions".

FIRST SPECIFIC EXAMPLE

Figure 5:
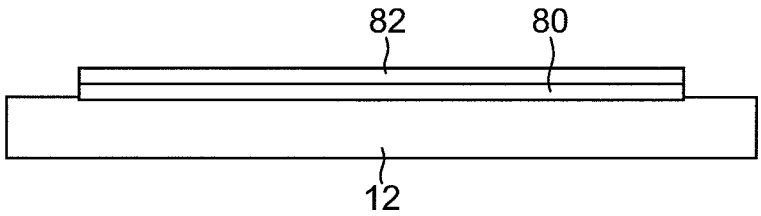
FIG. 5 is an illustrative diagram showing a schematic view of a layer structure of an image relating to a first specific example.

FIG. 5 is an illustrative diagram showing a schematic view of the image layer structure formed by the image forming process relating to a first specific example. The image shown in FIG. 5 has a layered structure in which a white base layer 80 is formed on the recording medium 12, and a color image layer 82 is formed (layered) onto the white base layer 80, and hence the number of image forming layers is two.

Figure 6:
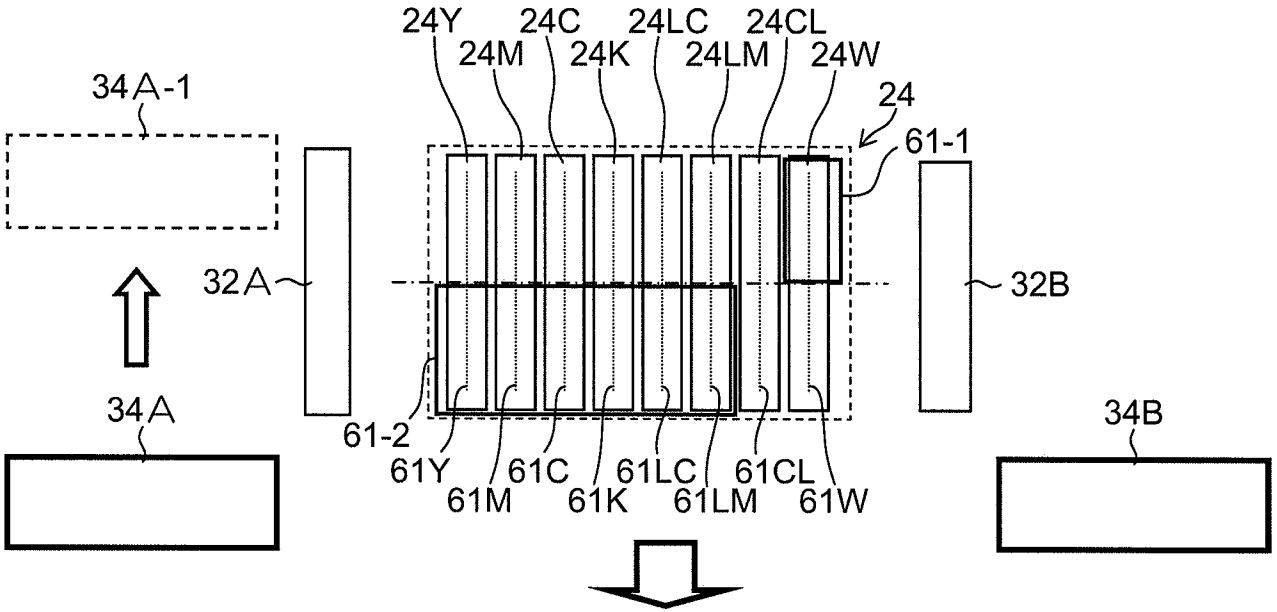
FIG. 6 is an illustrative diagram showing an example of the composition of the inkjet head and the ultraviolet light irradiation unit for forming an image shown in FIG. 5.

FIG. 6 is an illustrative diagram showing a schematic view of the composition of an inkjet head 24 for forming an image having the layered structure shown in FIG. 5 and the arrangement of the main curing light sources 34A, 34B. The recording medium conveyance to direction (X direction) is the up to down direction indicated by the downward arrow in FIG. 6, and the reciprocating direction (Y direction) of the carriage 30 is a horizontal direction.

As shown in FIG. 6, the nozzle rows 61 are divided into two regions, an upstream region 61-1 and a downstream region 61-2, white ink is ejected only from the upstream side region 61-1 of the nozzle row 61W, and color inks are ejected only from the downstream region 61-2 of the nozzle rows 61Y, 61M, 61C, 61K, 61LC, 61LM. When a white base layer 80 (see FIG. 5) has been formed by white ink ejected from the upstream region 61-1, the recording medium 12 is moved by a distance (($L_w$/2)/number of multiple passes) and a color image layer 82 is formed by color ink ejected from the downstream region 61-2 onto the previously formed white base layer 80.

While forming a color image layer 82 on the white base layer 80, white ink is ejected from the upstream region 61-1 of the nozzle 61W only, onto a white ink ejection position which is adjacent to the current color ink ejection position, on the upstream side thereof in the recording medium conveyance direction. In other words, simultaneously with the formation of the color image layer 82, formation of a white base layer 80 which will be the formation region for the next color image also proceeds. Furthermore, a multi-pass method as described previously is used for the ejection of white ink for forming the white base layer 80 and the ejection of color ink for forming the color image layer 82.

The main curing light source 34A is moved to the white ink ejection position indicated by the dotted line and labeled with reference numeral 34A-1 (a position aligned with the upstream region 61-1 of the nozzle row 61W where white ink is ejected, in the carriage movement direction) (the direction of movement is indicated by the upward arrow in the drawing), and ultraviolet light of almost the same amount as during the main curing process is irradiated by the main curing light source 34A immediately after the white ink has landed on the recording medium 12. On the other hand, the color inks receive a main curing process by the main curing light source 34B after the provisional curing process by the provision curing light sources 32A and 32B.

More specifically, step 1 is a step of forming a white base layer 80, in which the left-side main curing light source 34A in FIG. 6 is moved so as to correspond to the white ink ejection position, and the carriage 30 (see FIG. 3) is made to perform a scanning action (move) in the carriage movement direction. White ink is ejected from the upstream region 61-1 of the nozzle row 61W only, and following the nozzle row 61W (or before the nozzle row 61W in a scan from the right to left in FIG. 3), ultraviolet light of the same amount as a main curing process (not less than 10 mJ/cm$^2$ in one scanning action of the carriage) is irradiated in one scanning action of the carriage onto the white ink immediately after the ink lands on the recording medium 12, from the main curing light source 34A which scans (moves) in the carriage movement direction, and a white base layer 80 (see FIG. 5) in which the white ink is almost cured is formed.

Here, the white ink shows very conspicuous yellowing in the curing film, and therefore in order to prevent yellowing, the content of reaction initiator is reduced compared to color inks, and the like. Furthermore, since the white ink includes titanium oxide as a pigment, the white ink has properties whereby it is not liable to absorb ultraviolet light (not liable to curing), compared to the color inks or clear ink.

Considering a case where ultraviolet LED elements are used for the provisional curing light sources 32A, 32B and the main curing light sources 34A, 34B, the light emission waveband of the ultraviolet LED elements is the wavelength band 365 nm to 405 nm only, and countermeasures for the increased wavelength of the initiator contained in the ink are essential. On the other hand, since the ink curing film is yellowed due to the increased wavelength of the initiator, then the white ink and the clear ink, which may show highly marked yellowing, have a restricted initiator content.

Furthermore, since the white base layer 80 is a so-called solid image, then it is possible to use dots (droplets) of a large size compared to a color image, and provisional curing does not have to be carried out in order to prevent landing interference or to ensure the dot expansion time. Moreover, as described above, since the ultraviolet light transmissivity of the white ink (white base layer 80) is lower than the color ink, or the like, then activation energy of substantially the same amount as a main curing process is applied while the thickness of the white ink film is small, and a white ink curing process is carried out. Consequently, the white ink is fully cured by applying activation energy equal to that of a main curing process immediately after the ink lands on the recording medium 12.

Step 2 is a step of forming a color image layer 82, and at the ejection position of the color ink which is a distance ($L_w/2$) to the downstream side in the recording medium conveyance direction from the white ink ejection position on the recording medium 12 (the white base layer 80 which has already been formed), the carriage 30 is made to perform a scanning action in the carriage movement direction and color inks are ejected from the downstream region 61-2 of the nozzle rows 61Y, 61M, 61C, 61K, 61LC, 61LM.

Furthermore, ultraviolet light of a low amount (1 to 5 mJ/cm$^2$ per scanning action of the carriage) is irradiated in one scanning action of the carriage onto the color inks immediately after landing on the recording medium 12, from the provisional curing light source 32A, 32B which follows the nozzle rows 61Y, 61M, 61C, 61K, 61LC, 61LM, thereby provisionally curing the color inks and transforming same to a gel state. In so doing, landing interference of the color inks is prevented.

The low amount of light for provisional curing which is applied in the image formation described in the present embodiment is approximately 1/10 to 1/2 of the high amount of light for main curing or curing of white ink.

Step 3 is the period from the step of forming a color image layer 82 until the main curing process, during which the portion where a color image layer 82 has been superimposed onto the white base layer 80 at a distance ($L_w/2$) further to the downstream side in the recording medium conveyance direction from the color ink ejection position on the recording medium 12 has left the ejection position of the nozzle rows 61 and becomes positioned in the ultraviolet light irradiation area of the main curing light source 34B. By allowing a prescribed time from the provisional curing processing step to the main curing processing step, the adhesive affinity between the white base layer 80 and the color image layer 82 is raised, and as well as promoting the spreading of dots, reduction of the pile height is also promoted and the glossiness of the color image is improved.

Step 4 is a main curing process step in which the main curing light source 34B is used which is disposed to the downstream side of the inkjet head 24 in terms of the recording medium conveyance direction, and the carriage 30 performs a scanning action in the carriage movement direction and the color image layer 82 which has moved to the ultraviolet light irradiation position is subjected to a main curing process by the main curing light source 34B. The amount of ultraviolet light in the main curing process of the color image layer 82 is not less than 10 mJ/cm$^2$ per scanning action of the carriage. By performing main curing of the color image layer 82, the glossiness of the color image layer 82 is further enhanced, and improved adhesion between the white base layer 80 and the color image layer 82 is achieved as well as hardening the film of the color image layer 82.

SECOND SPECIFIC EXAMPLE

Figure 7:
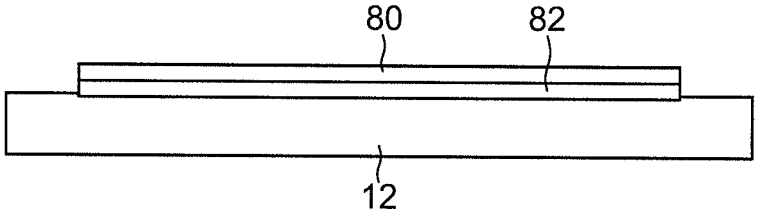
FIG. 7 is an illustrative diagram showing a schematic view of a layer structure of an image relating to a second specific example.
Figure 8:
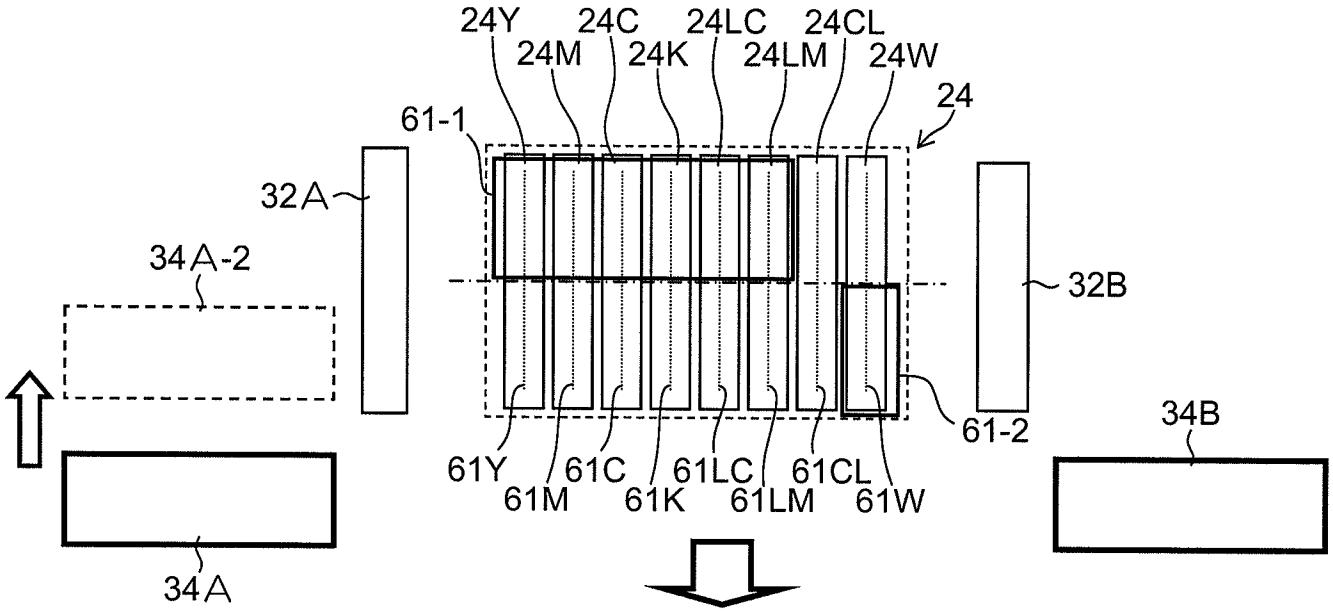
FIG. 8 is an illustrative diagram showing an example of the composition of the inkjet head and the ultraviolet light irradiation unit for forming an image shown in FIG. 7.

FIG. 7 is an illustrative diagram showing a schematic view of the layer structure of the image formed by the image forming process relating to a second specific example, and FIG. 8 is an illustrative diagram showing a schematic view of the composition of an inkjet head 24 for forming an image having the layer structure shown in FIG. 7 and the arrangement of the main curing light sources 34A, 34B. In the following description, parts which are the same as or similar to the part described above are labeled with the same reference numerals and further explanation thereof is omitted here.

The image shown in FIG. 7 has two image forming layers, namely, a color image layer 82 which is formed on a transparent recording medium 12, and a white base layer 80 which is formed on the color image layer 82. When an image having this structure is viewed from the rear surface of the recording medium 12 (the surface opposite to the side where the image is formed), then the color image layer 82 can be perceived with the white base layer 80 as a background.

Step 1 is a step of forming a color image layer 82, in which the main curing light source 34A on the left-hand side in FIG. 8 is moved to a white ink ejection position indicated by a dotted line labeled with reference numeral 34A-2 (a position aligned, in the carriage movement direction, with the downstream side region 61-2 of the nozzle row 61W) (the direction of movement being depicted by the upward arrow). The carriage 30 is caused to perform a scanning action in the carriage movement direction and color inks are ejected onto the recording medium 12 from the upstream region 61-1 of the nozzle rows 61Y, 61M, 61C, 61K, 61 LC, 61 LM. Furthermore, ultraviolet light of a low amount (1 to 5 mJ/cm$^2$ per scanning action of the carriage) is irradiated in one scanning action of the carriage onto the color inks immediately after landing on the recording medium 12, from the provisional curing light source 32A, 32B which follows the nozzle rows 61Y, 61M, 61C, 61K, 61LC, 61LM, thereby provisionally curing the color inks and transforming same to a gel state. In so doing, landing interference of the color inks is prevented.

Step 2 is the time from the step of forming the color image layer 82 to the step of forming the white base layer 80, during which the adhesive affinity between the recording medium 12 and the color image layer 82 is raised by maintaining a provisional curing state for a prescribed period of time, the spreading of dots is promoted, and reduction of the pile height is promoted, as well as improving the glossiness of the color image.

Step 3 is a step of forming a white base layer 80, and at a white ink ejection position which is a distance ($L_w$/2) in the recording medium conveyance direction from the color ink ejection position on the recording medium 12 (on the color image layer 82 that has been formed already), the carriage 30 (see FIG. 3) performs a scanning action in the carriage movement direction and the white ink is ejected onto the color image layer 82 which is in a semi-cured state, from the downstream region 61-2 of the nozzle row 61W only. Ultraviolet light of a high amount equivalent to that of the main curing process (10 mJ/cm$^2$ per scanning action of the carriage) or more is irradiated in one scanning action of the carriage onto the white ink immediately after landing on the recording medium 12, and onto the color image layer 82 which is in a semi-cured state beneath the white ink, from the main curing light source 34A which performs a scanning action in the carriage movement direction following the nozzle row 61W (or before the nozzle row 61W in a scanning action from the right to left in FIG. 3), whereby a white base layer 80 (see FIG. 5) is formed and curing of the color image layer 82 is promoted.

Step 4 is a main curing processing step in which a main curing process of the white base layer 80 and the color image layer 82 is performed by using the main curing light source 34B disposed on the downstream side of the inkjet head 24 in the recording medium conveyance direction. The amount of the ultraviolet light in this main curing process is 10 mJ/cm$^2$ per scanning action of the carriage. By performing main curing of the white base layer 80 and the color image layer 82, the glossiness of the color image layer 82 is further enhanced, and improved adhesion between the white base layer 80 and the color image layer 82 is achieved as well as hardening the film of the color image layer 82.

THIRD SPECIFIC EXAMPLE

Figure 9:
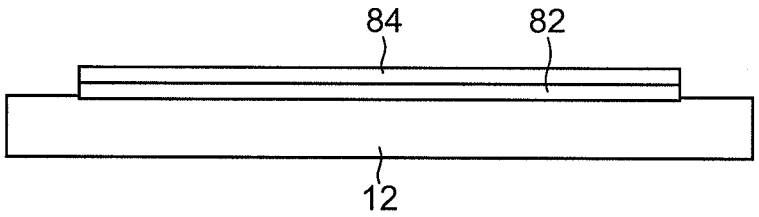
FIG. 9 is an illustrative diagram showing a schematic view of a layer structure of an image relating to a third specific example.
Figure 10:
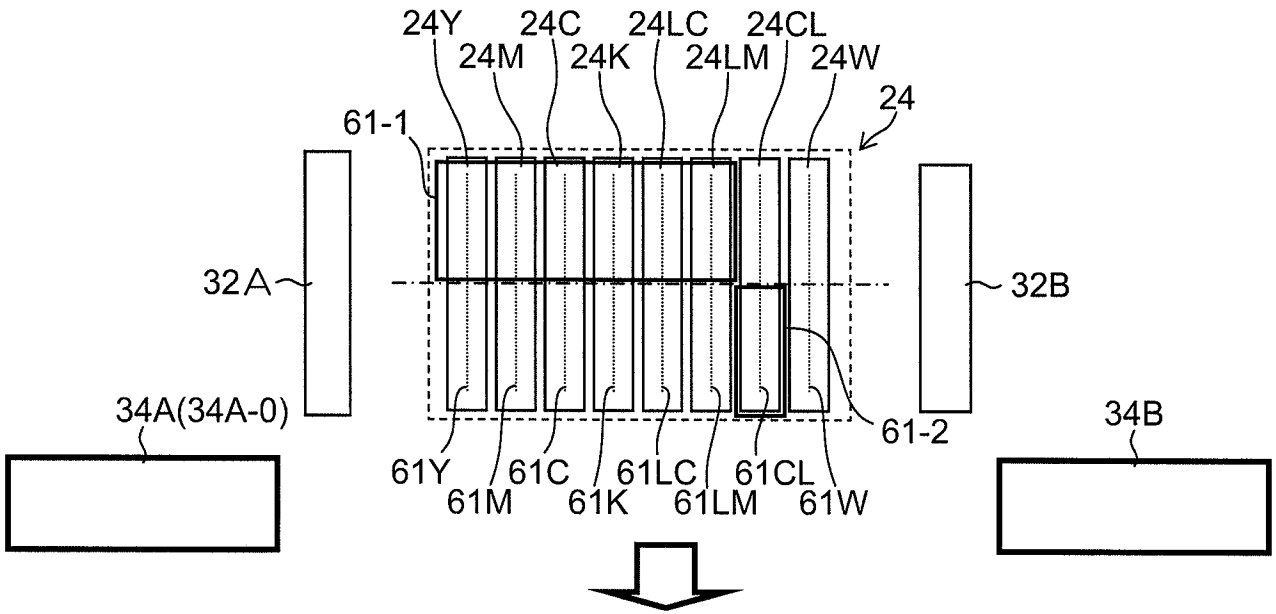
FIG. 10 is an illustrative diagram showing an example of the composition of the ultraviolet light irradiation unit for forming an image shown in FIG. 9.

FIG. 9 is an illustrative diagram showing a schematic view of the layer structure of the image formed by the image forming process relating to a third specific example, and FIG. 10 is an illustrative diagram showing a schematic view of the composition of an inkjet head 24 for forming an image having the layer structure shown in FIG. 9 and the arrangement of the main curing light sources 34A, 34B. The image shown in FIG. 9 has two image forming layers, namely, a color image layer 82 which is formed on a recording medium 12, and a transparent layer 84 which is formed on the color image layer 82.

Step 1 is a step of forming a color image layer 82, in which the carriage 30 performs a scanning action in the carriage movement direction while the main curing light source 34A is not moved but remains to the downstream side of the inkjet head 24 in the recording medium conveyance direction (labeled with reference numeral 34A-0), and color inks are ejected onto the recording medium 12 from the upstream region 61-1 of the nozzle rows 61Y, 61M, 61C, 61K, 61LC and 61LM. Furthermore, ultraviolet light of a low amount (1 to 5 mJ/cm$^2$ per scanning action of the carriage) is irradiated in one scanning action of the carriage onto the color inks immediately after landing on the recording medium 12, from the provisional curing light sources 32A, 32B which follow the nozzle rows 61Y, 61M, 61C, 61K, 61LC, 61LM, thereby provisionally curing the color inks and transforming same to a gel state. In so doing, landing interference of the color inks is prevented.

Step 2 is a step of forming a transparent layer 84, and at a clear ink ejection position which is at a distance ($L_w$/2) on the downstream side in the recording medium conveyance direction from the color ink ejection position on the recording medium 12 (on the color image layer 82 that has been formed already), the carriage 30 performs a scanning action in the carriage movement direction and clear ink is ejected onto the color image layer 82 which is in a semi-cured state, from the downstream region 61-2 of the nozzle row 61CL. Furthermore, ultraviolet light of a low amount (1 to 5 mJ/cm$^2$ per scanning action of the carriage) is irradiated in one scanning action of the carriage onto the clear ink immediately after landing on the color image layer 82, from the provisional curing light source 32A, 32B which follows the nozzle row 61CL, thereby provisionally curing the clear ink and setting the ink to a gel state, and hence preventing landing interference. The clear ink has high transmissivity of ultraviolet light and therefore is readily curable.

Step 3 is the period from the step of forming a color image layer 82 until a main curing process, during which the portion where a transparent layer 84 is superimposed on a color image layer 82 at a distance ($L_w$/2) further to the downstream side in the recording medium conveyance direction from the color ink ejection position of the recording medium 12 leaves the ejection position of the nozzle rows 61 and becomes positioned in the ultraviolet light irradiation area of the main curing light source 34B. By maintaining the provisionally cured state of the clear ink for a prescribed period of time, permeation into the color image layer 82, spreading of the dots and reduction in the pile height are promoted. Moreover, the glossiness of the color image layer 82 is further enhanced, and the adhesion between the recording medium 12 and the color image layer 82, and the adhesion between the color image layer 82 and the transparent layer 84 are also improved.

Step 4 is a main curing process step in which the carriage 30 performs a scanning action in the carriage movement direction, and the color image layer 82 and the transparent to layer 84 are subjected to a main curing process by the main curing light sources 34A, 34B which are disposed to the downstream side of the inkjet head 24 in terms of the recording medium conveyance direction. The amount of the ultraviolet light in this main curing process is not less than 10 mJ/cm$^2$ per scanning action of the carriage. By performing main curing of the color image layer 82 and the transparent layer 84, the adhesion between the recording medium 12 and the color image layer 82 is further enhanced and hardening of the color image layer 82 is also achieved.

FOURTH SPECIFIC EXAMPLE

Figure 11:
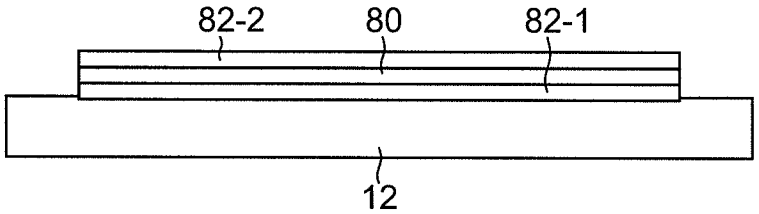
FIG. 11 is an illustrative diagram showing a schematic view of a layer structure of an image relating to a fourth specific example.
Figure 12:
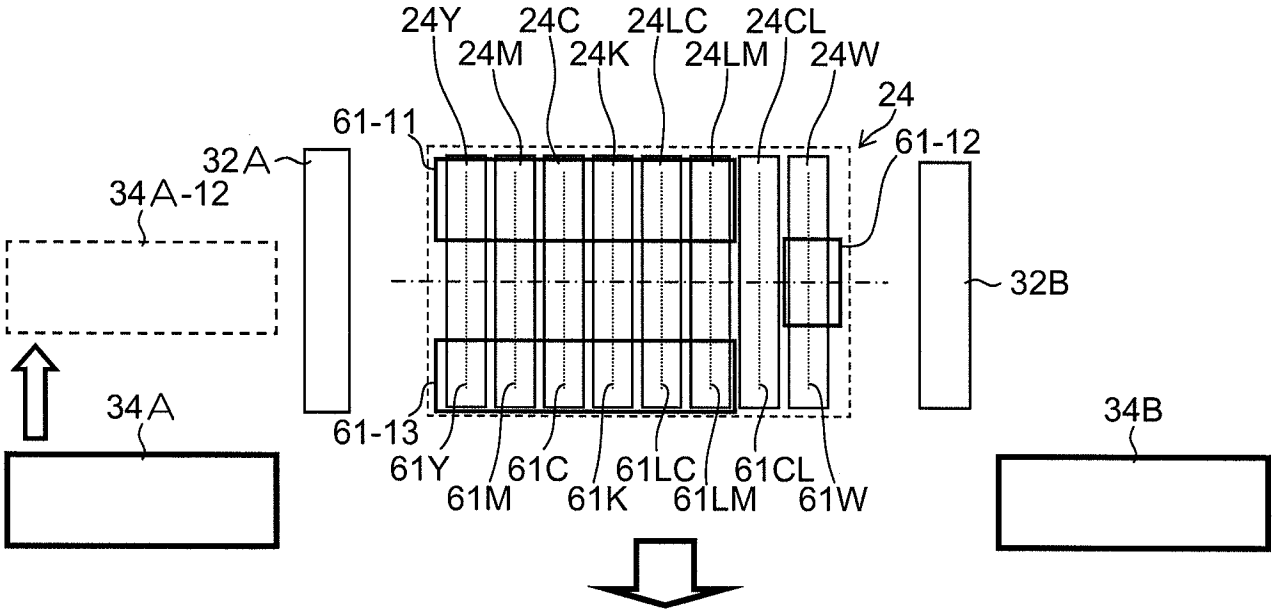
FIG. 12 is an illustrative diagram showing an example of the composition of the ultraviolet light irradiation unit for forming an image shown in FIG. 11.

FIG. 11 is an illustrative diagram showing a schematic view of the layer structure of the image formed by the image forming process relating to a fourth specific example, and FIG. 12 is an illustrative diagram showing a schematic view of the composition of an inkjet head 24 for forming an image having the layer structure shown in FIG. 11 and the arrangement of the main curing light source 34A. The image shown in FIG. 11 has three image forming layers, and has a structure in which the layers are laid in order: color image layer 82-1, white base layer 80 and color image layer 82-2, on the transparent recording medium 12.

In other words, the image has a structure in which a white base layer 80 is sandwiched between upper and lower image layers 82-1 and 82-2. In the image having this structure, the color image layers 82 are viewed from both surfaces of the recording medium 12, with the white base layer 80 as a background.

As shown in FIG. 12, the nozzle rows 61 are divided into three regions, an upstream region 61-11, a central region 61-12 and a downstream region 61-13, color inks are ejected only from the upstream region 61-11 and the downstream region 61-13 of the nozzle rows 61Y, 61M, 61C, 61K, 61LC, 61LM, and white ink is ejected only from the central region 61-12 of the nozzle row 61W.

More specifically, when a color image layer 82-1 has been formed by color inks ejected from the upstream region 61-11 of the nozzle rows 61Y, 61M, 61C, 61K, 61LC, 61LM, a white base layer 80 is formed (layered) by white ink ejected from the central region 61-12 of the nozzle row 61W onto the color image layer 82-1, at a white ink ejection position which is at a distance of ($L_w/3$) to the downstream side on the recording medium 12, in terms of the conveyance direction of the recording medium, and furthermore, a color image layer 82-2 is formed (layered) by color inks ejected from the downstream region 61-13 of the nozzle rows 61Y, 61M, 61C, 61K, 61LC, 61LM, at a color ink ejection position which is at a distance of ($L_w/3$) to the downstream side on the recording medium 12 in terms of the conveyance direction of the recording medium.

Furthermore, the main curing light source 34A is moved to the white ink ejection position which is indicated by the dotted line and labeled with reference numeral 34A-12 (a position aligned with the central region 61-12 of the nozzle row 61W which ejects white ink in the carriage movement direction), (the direction of movement being indicated by the upward arrow in the drawing), and ultraviolet light of a high amount equal to or greater than a main curing process (10 mJ/cm$^2$ per scanning action of the carriage) is irradiated in one scanning action of the carriage onto the white ink immediately after landing on the recording medium 12. On the other hand, in the case of the color inks, after a provisional curing process by irradiation of ultraviolet light of 1 to 5 mJ/cm$^2$ per scanning action of the carriage from the provisional curing light sources 32A, 32B, a main curing process is carried out by irradiation of ultraviolet light of not less than 10 mJ/cm$^2$ per scanning action of the carriage from the main curing light source 34B (or the main curing light source 34A).

Step 1 is a step of forming a color image layer 82-1, in which the main curing light source 34A is moved to a color ink ejection position, the carriage 30 performs a scanning action in the carriage movement direction, and color inks are ejected onto the recording medium 12 from the upstream region 61-11 of the nozzle rows 61Y, 61M, 61C, 61K, 61LC and 61 LM. Furthermore, ultraviolet light of a low amount (1 to 5 mJ/cm$^2$ per scanning action of the carriage) is irradiated in one scanning action of the carriage onto the color inks immediately after landing on the recording medium 12, from the provisional curing light source 32A, 32B which follows the nozzle rows 61Y, 61M, 61C, 61K, 61LC, 61LM, thereby provisionally curing the color inks and transforming same to a gel state. In so doing, landing interference of the color inks is prevented.

Step 2 is the time from the step of forming the color image layer 82-1 to the step of forming the white base layer 80, during which the portion where the color image layer 82 has been formed is maintained for a prescribed period of time in a provisionally cured state, whereby the adhesion between the color image layer 82-1 and the recording medium 12 is improved and dot spreading and reduction of the pile height are promoted.

Step 3 is a step of forming a white base layer 80, and at a white ink ejection position which is at a distance ($L_w/3$) in the recording medium conveyance direction from the color ink ejection position on the recording medium 12, the carriage 30 performs a scanning action in the carriage movement direction and white ink is ejected onto the color image layer 82-1 which is in a semi-cured state, from the central region 61-12 of the nozzle row 61W only. Thereupon, ultraviolet light of a high amount equal to that of the main curing process (not less than 10 mJ/cm$^2$ per scanning action of the carriage) is irradiated in one scanning action of the carriage, onto the white ink immediately after landing on the recording medium 12 and onto the color image layer 82-1 which is in a provisionally cured state below the white ink, from the main curing light source 34A which performs a scanning action following the nozzle row 61W, thereby forming a white base layer 80 in which the white ink is virtually cured.

Step 4 is a step of forming a color image layer 82-2, and at an ejection position of the color ink which is at a distance ($L_w/3$) further to the downstream side in the recording medium conveyance direction from the white ink ejection position on the recording medium 12, the carriage 30 is made to perform a scanning action in the carriage movement direction and color inks are ejected onto the white base layer 80 from the downstream region 61-13 of the nozzle rows 61Y, 61M, 61C, 61K, 61LC, 61LM. Furthermore, ultraviolet light of a low amount (1 to 5 mJ/cm$^2$ per scanning action of the carriage) is irradiated in one scanning action of the carriage onto the color inks immediately after landing on the recording medium 12, from the provisional curing light source 32A, 32B which follows the nozzle rows 61Y, 61M, 61C, 61K, 61LC, 61LM, thereby provisionally curing the color inks and transforming same to a gel state.

In so doing, landing interference of the color inks which land on the white base layer 80 is prevented, and a semi-curing state is maintained for a prescribed period of time, thereby promoting the spreading of the dots and reduction of the pile height.

Step 5 is the time period from the step of forming the color image layer 82 to the main curing step, during which a main curing process is carried out onto the color image layers 82-1, 82-2 and the white base layer 80 which is sandwiched between the color image layers 82-1, 82-2, using the main curing light source 34B which is disposed to the downstream side of the inkjet head 24 in the recording medium conveyance direction. The amount of the ultraviolet light in this main curing process is not less than 10 mJ/cm$^2$ per scanning action of the carriage. By performing main curing of the color image layers 82-1 and 82-2 and the white base layer 80, then the glossiness of the color image layers 82-1 and 82-2 is further improved, and the adhesion between the recording medium 12 and the color image layer 82-1 and the adhesion between the color image layers 82-1 and 82-2 and the white base layer 80 are improved, as well as hardening the color image layers 82-1 and 82-2.

FIFTH SPECIFIC EXAMPLE

Figure 13:
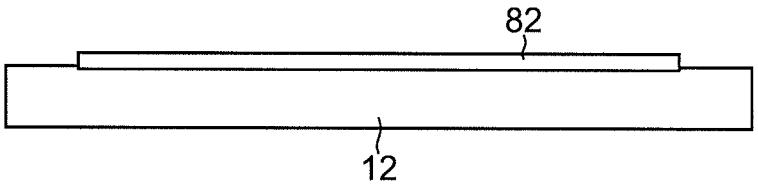
FIG. 13 is an illustrative diagram showing a schematic view of a layer structure of an image relating to a fifth specific example.
Figure 14:
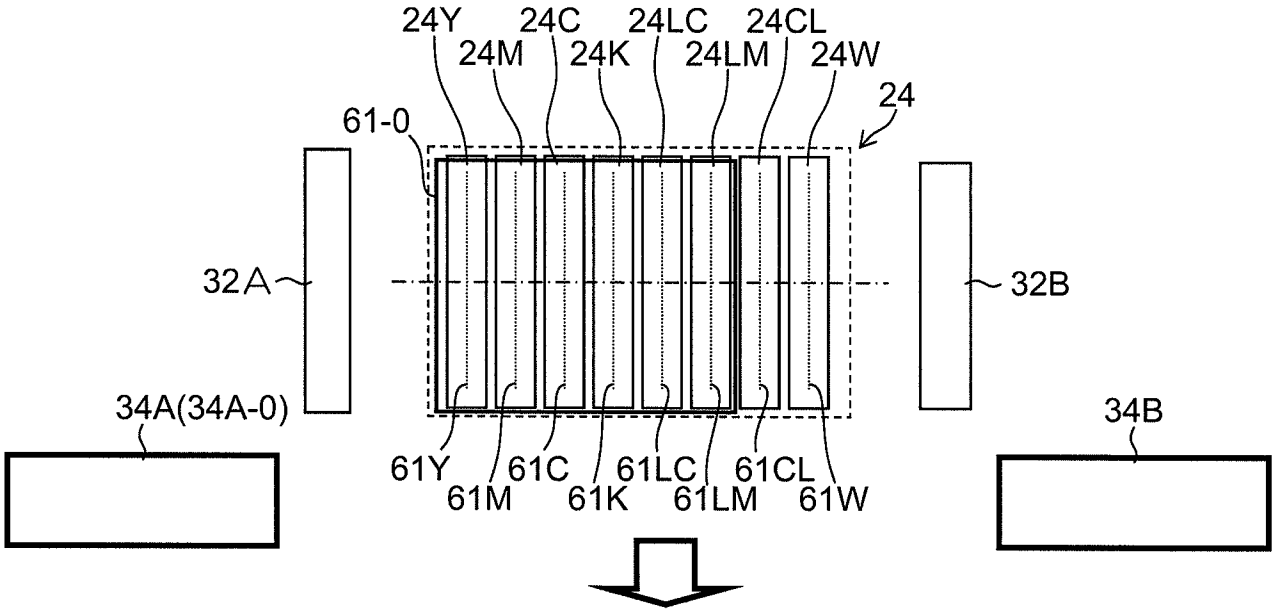
FIG. 14 is an illustrative diagram showing an example of the composition of the ultraviolet light irradiation unit for forming an image shown in FIG. 13.

FIG. 13 is an illustrative diagram showing a schematic view of the layer structure of the image formed by the image forming process relating to a fifth specific example, and FIG. 14 is an illustrative diagram showing a schematic view of the composition of an inkjet head 24 for forming an image having the layer structure shown in FIG. 13 and the arrangement of the main curing light sources 34A, 34B. The image shown in FIG. 13 has one image formation layer, and only a color image layer 82 is formed on the recording medium 12.

As shown in FIG. 14, the nozzle rows 61Y, 61M, 61C, 61K, 61LC, 61LM from which color inks are ejected are not divided and all of the nozzles are used in formation of a color image. On the other hand, the nozzle row 61CL for clear ink and the nozzle row 61W for white ink are not used.

Step 1 is a step of forming a color image layer 82, in which color inks are ejected onto the recording medium 12 from the nozzle rows 61Y, 61M, 61C, 61K, 61LC, 61LM. Furthermore, ultraviolet light of a low amount (1 to 5 mJ/cm$^2$ per scanning action of the carriage) is irradiated in one scanning action of the carriage onto the color inks immediately after landing on the recording medium 12, from the provisional curing light source 32A, 32B which follows the nozzle rows 61Y, 61M, 61C, 61K, 61LC, 61LM, thereby provisionally curing the color inks and transforming same to a gel state. In so doing, landing interference of the color inks is prevented.

Step 2 is the time period from the step of forming the color image layer 82 until the main curing step, and by maintaining the semi-cured state for a prescribed period of time, adhesion of the color image layer 82 and the recording medium 12 is improved, and spreading of the dots and reduction of the pile height are promoted.

Step 3 is a main curing process step in which a main curing process is carried out on the color image layer 82 by using the main curing light sources 34A (indicated by reference 34A-0) and 34B which are disposed on the downstream side of the inkjet head 24 in terms of the recording medium conveyance direction. The amount of the ultraviolet light in this main curing process is not less than 10 mJ/cm$^2$ per scanning action of the carriage. By performing main curing of the color image layer 82, the glossiness of the color image layer 82 is enhanced, and improved adhesion between the recording medium 12 and the color image layer 82 is achieved, as well as hardening the film of the color image layer 82.

In the first to fifth specific examples described above, a composition is desirable in which, if the layer formation mode which is specified by the mode of the image formed (the type of ink forming the respective layers, the number of layers, and the like) is switched, then the main curing light source 34A is moved automatically to the white ink ejection position. The layer formation mode can be switched in accordance with an input signal which is input by the input apparatus described below (indicated the reference numeral 122 in FIG. 20).

A possible example of a composition in which the main curing light source 34A is moved automatically by this switching of the layer formation mode is a light source movement unit which includes a cam mechanism which pushes the main curing light source 34A outside the image forming region in the carriage movement direction, and a lock mechanism (stopper) which locks the main curing light source 34A in a prescribed position.

Figure 15:
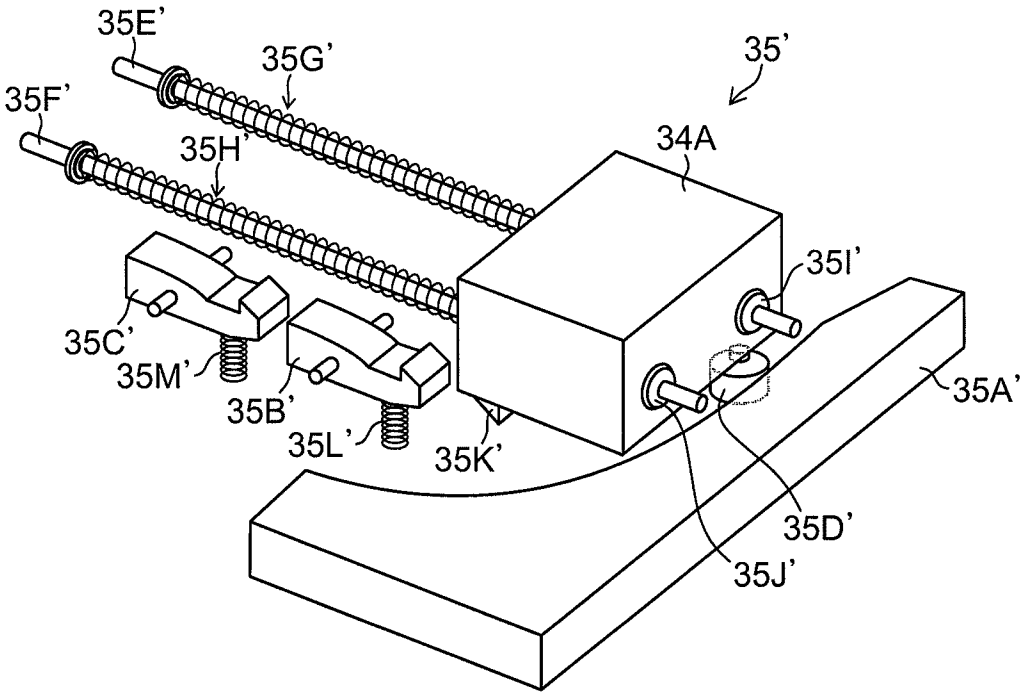
FIG. 15 is a perspective diagram showing a further example of the composition of the light source movement mechanism shown in FIG. 4.

FIG. 15 is a perspective diagram showing a composition of a light source movement unit 35' including a cam mechanism (cam 35A') and a lock mechanism (stopper 35B', 35C', etc.). As shown in FIG. 15, when the carriage 30 (see FIG. 3) performs a scanning action in the leftward direction in the drawing and is moved to the arrangement position of the cam 35A' which is provided outside the image forming region, the cam roller 35D' provided on the bottom surface of the provisional curing light source 34A is moved along the cam curve (surface) formed on the cam 35A', and the provisional curing light source 34A' slides in the sub-scanning direction X along slide shafts 35E', 35F' (the direction indicated by the white arrow in FIG. 17).

Figure 17:
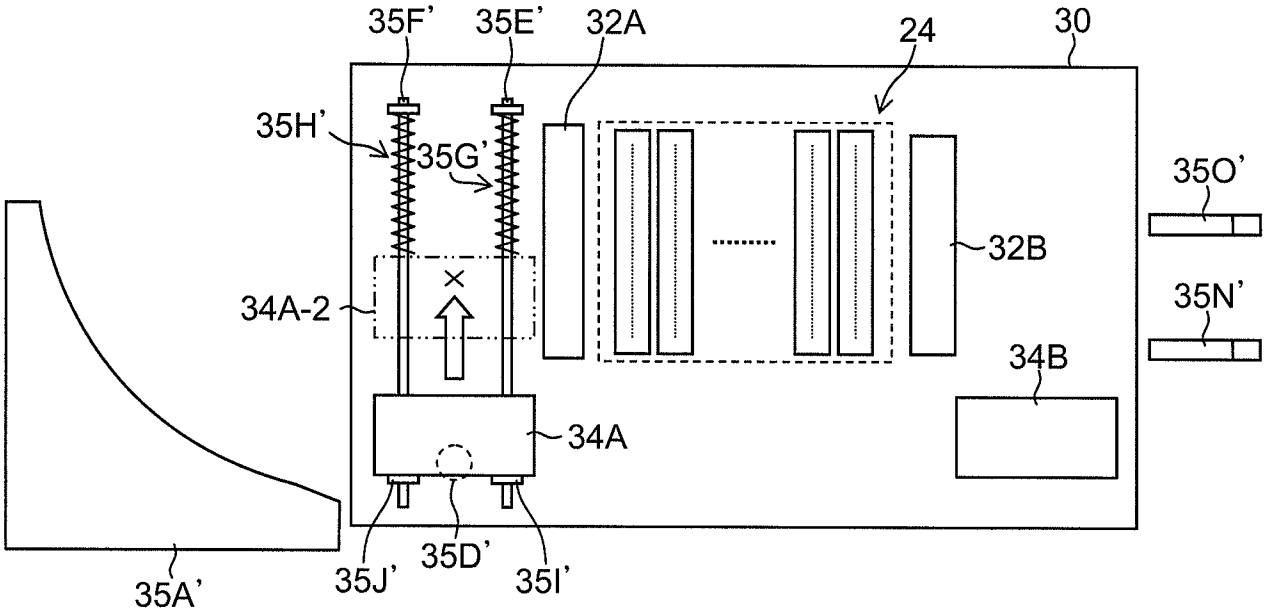
FIG. 17 is a plan view diagram showing an arrangement of the light source movement mechanism shown in FIG. 15.

The provisional curing light source 34A' is impelled to the downstream side of the inkjet head 24 in the recording medium conveyance direction, by pressing springs 35G' and 35H' (the direction opposite to the direction of the white arrow shown in FIG. 17), and stoppers 35I' and 35J are provided on the ends of the slide shafts 35E' and 35F'.

When a hook section 35K' which is provided on the bottom surface of the provisional curing light source 34A is provided with the carriage 30 in correspondence to the stop position of the provisional curing light source 34A' and arrives at the position of locking mechanisms 35B', 35C' which are impelled upwards from the lower side by the springs (elastic deformation members) 35L', 35M', the hook section 35K' and the locking mechanism 35B' (35C') engage and the provisional curing light source 34A is fixed in a prescribed position.

For example, the stopper 35B' corresponds to the fixing position of the provisional curing light source 34A' which is labeled with reference numeral 34A-1 in FIG. 6, and the stopper 35C' corresponds to the fixing position of the provisional curing light source 34A' which is labeled with reference numeral 34A-2 in FIG. 17 (FIG. 8).

Figure 16:
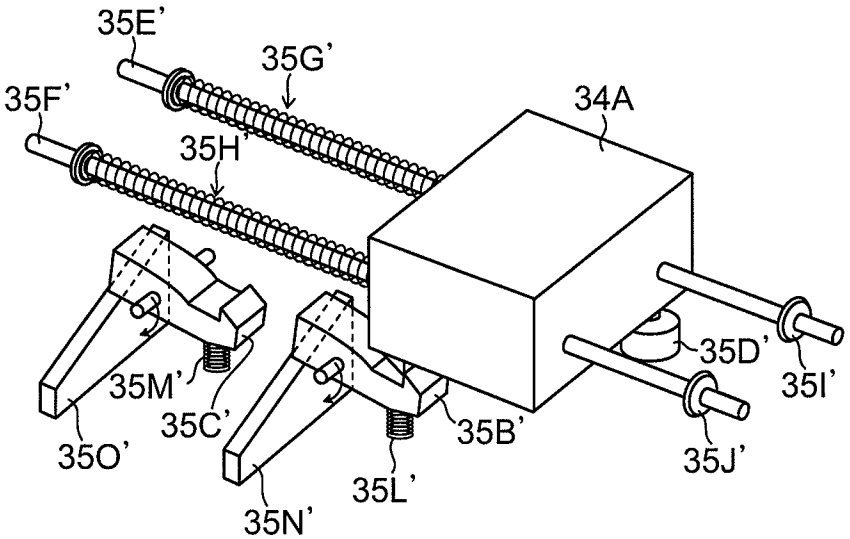
FIG. 16 is a perspective diagram showing an unlocked state of the light source movement mechanism shown in FIG. 15.

FIG. 16 is a perspective diagram showing an unlocked state of the light source movement mechanism shown in FIG. 15. When the carriage 30 is moved to the right-hand side in FIG. 3 and reaches the arrangement position of unlocking cams 35N' and 35O' outside the image forming region, then the ends of the locking mechanisms 35B', 35C' which are opposite to the ends which engage with the hook section 35K' are pushed upwards by the unlocking cams 35N' and 35O', the ends of the locking mechanisms 35B', 35C' which engage with the hook section 35K' are pushed downwards, and the engagement between the locking mechanism 35B' (35C') and the hook section 35K' is released.

In so doing, the provisional curing light source 34A is moved toward the downstream side of the inkjet head 24 in terms of the recording medium conveyance direction, due to the elastic force (restoring force) of the pressing springs 35G', 35H', abuts against the stoppers 35I' and 35J' provided on the ends of the slide shafts 35E' and 35F', and halts in this position.

FIG. 17 is a plan diagram showing the arrangement of a light source movement mechanism shown in FIG. 15. As shown in FIG. 17, the cam 35A' and the unlocking cams 35N' and 35O' are provided outside the image forming region, and the remainder of the structure is mounted on the carriage 30. According to this composition, by moving the carriage 30 to the position of a cam mechanism (locking mechanism, unlocking mechanism) provided outside the image formation region, it is possible to move the main curing light source 34A automatically to a white ink ejection position.

As a further embodiment, desirably, the position (current position) of the main curing light source 34A is detected by a sensor and a notification is shown on a display panel if the main curing light source 34A is not situated in the desired position corresponding to the image forming mode. In this mode, it is possible for an operator to observe the information displayed on the display panel, and to change the position of the main curing light source 34A manually.

In the present embodiment, description of the specific examples is omitted, but image formation similar to that of the first to fifth specific examples described above is also possible when a layer of metal ink is formed by replacing the white ink with metal ink. More specifically, if the background and the underlying layer are formed by using an ink which has low ultraviolet light absorptivity and relatively low sensitivity and slow curing in relation to to ultraviolet light, compared to color inks or clear ink, the ink which forms the background layer (underlying layer) is subjected to a main curing process without performing a provisional curing process.

The sensitivity with respect to the activation light beam (speed of curing) in the present invention is defined as indicated below. Firstly, an ink film having a uniform film thickness is produced and exposed in stepwise fashion while increasing the amount of exposure light, whereupon inkjet paper is rubbed against the film and it is checked visually whether or not transferred material has adhered to the inkjet paper rubbed against the film of ink. An ink which requires a large amount of exposure light until no ink adheres to the inkjet paper rubbed against same is defined as a slow-curing ink having relatively low sensitivity with respect to ultraviolet light.

More specifically, black ink, white ink and metallic ink are given as examples of slow-curing inks which have low sensitivity with respect to ultraviolet light. These inks have poor light transmissivity from the ultraviolet band through the visible band, and take a long time to cure compared to color inks such as yellow, cyan, and magenta inks.

In other words, slow-curing inks which have relatively low sensitivity to ultraviolet light, such as black ink, white ink and metallic ink have broad absorptivity (corresponding to a broad frequency range) from the ultraviolet band through the visible light band (200 nm to 700 nm), in contrast to color inks, such as yellow, cyan and magenta inks, and therefore transmission is difficult in both short wavelengths and long wavelengths. For example, if it is sought to achieve an image color density which is demanded currently in the market, then the light transmissivity of the color inks at 365 nm, which is the main peak wavelength of many light sources, is approximately 1.5 times to 10 times the transmissivity of white ink, etc.

Furthermore, if an ultraviolet light-emitting diode which only has a long light emission wavelength (365 nm to 405 nm) is employed for the curing light source, then long wavelength characteristics are essential in the initiator, and this may lead to yellowing of the cured film. Therefore, in the case of clear ink, and the like, which may show marked yellowing, the amount of initiator is restricted, sensitivity to ultraviolet light is low and curing is slow.

MODIFICATION EXAMPLE

Figure 18:
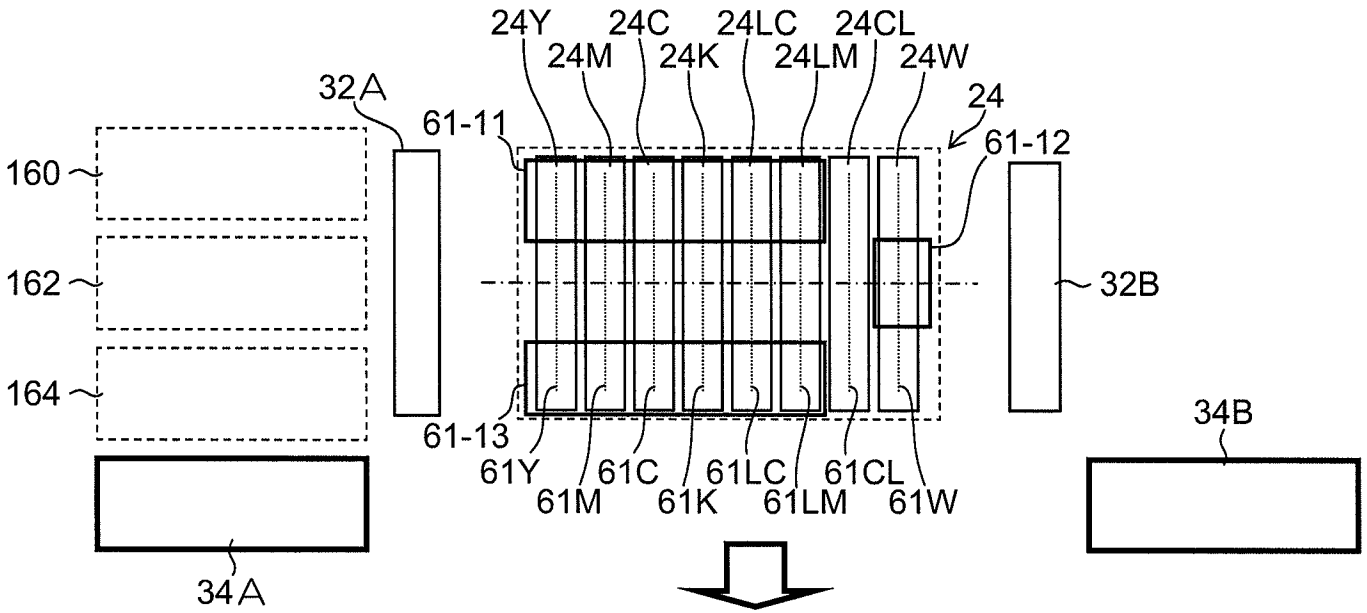
FIG. 18 is an illustrative diagram showing a schematic view of a modification example of a main curing light source.

FIG. 18 is an illustrative diagram showing a schematic view of a modification example of a main curing light source 34A. The unit module of the main curing light source 34A shown in FIG. 18 is formed as a cassette, and cassette (main curing light source unit module) insertion sections 160, 162, 164 in which a main curing light source unit module is installed are provided on a carriage 30 (see FIG. 3). In the example shown in FIG. 18, cassette insertion sections 160, 162, 164 are provided from the upstream side in the recording medium conveyance direction, so as to correspond to a case where the nozzle rows 61 are divided into three parts (fourth specific example).

In other words, a desirable mode is one where cassette insertion sections of the same number as the maximum number of image forming layers, $N_{max}$, are provided in such a manner that a main curing light source unit module is inserted into a cassette insertion section corresponding to the white ink ejection position. In this case, the length of the ultraviolet light irradiation area of the main curing light source unit module, in the recording medium conveyance direction is (total length of nozzle rows $L_w$/maximum number of image forming layers $N_{max}$).

Ink Supply System

Figure 19:
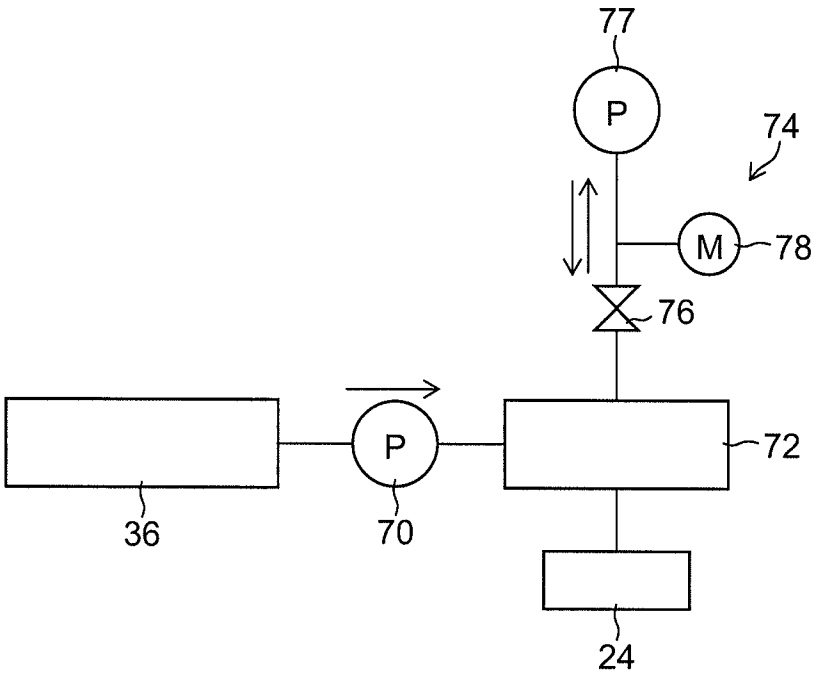
FIG. 19 is a block diagram showing the general composition of the ink supply system of the inkjet head shown in FIG. 1.

FIG. 19 is a block diagram showing a configuration of an ink supply system of the inkjet recording apparatus 10. As shown in FIG. 19, ink accommodated in an ink cartridge 36 is suctioned by the supply pump 70, and is conveyed to the inkjet head 24 via a sub-tank 72. For the sub-tank 72, a pressure adjustment unit 74 for adjusting the pressure of the ink in the sub-tank 72 is provided.

The pressure adjustment unit 74 includes a pressurization depressurization pump 77 which is connected to the sub tank 72 by means of a valve 76, and a pressure gauge 78 which is provided between the valve 76 and the pressurization depressurization pump 77.

During normal printing, the pressurization depressurization pump 77 operates in terms of a direction such that ink inside the sub-tank 72 is suctioned, and the pressure inside the sub-tank 72 and a negative pressure inside the inkjet head 24 are kept in a negative pressure state. On the other hand, during maintenance of the inkjet head 24, the pressurization depressurization pump 77 is operated in a direction such that the pressure of the ink inside the sub tank 72 is increased, thereby forcibly raising the internal pressure of the sub-tank 72 and the internal pressure of the inkjet head 24, and ink inside the inkjet head 24 is expelled via nozzles. The ink which has been forcibly expelled from the inkjet head 24 is accommodated in the ink receptacle of the cap (not shown) described above.

Description of Inkjet Recording Apparatus Control System

Figure 20:
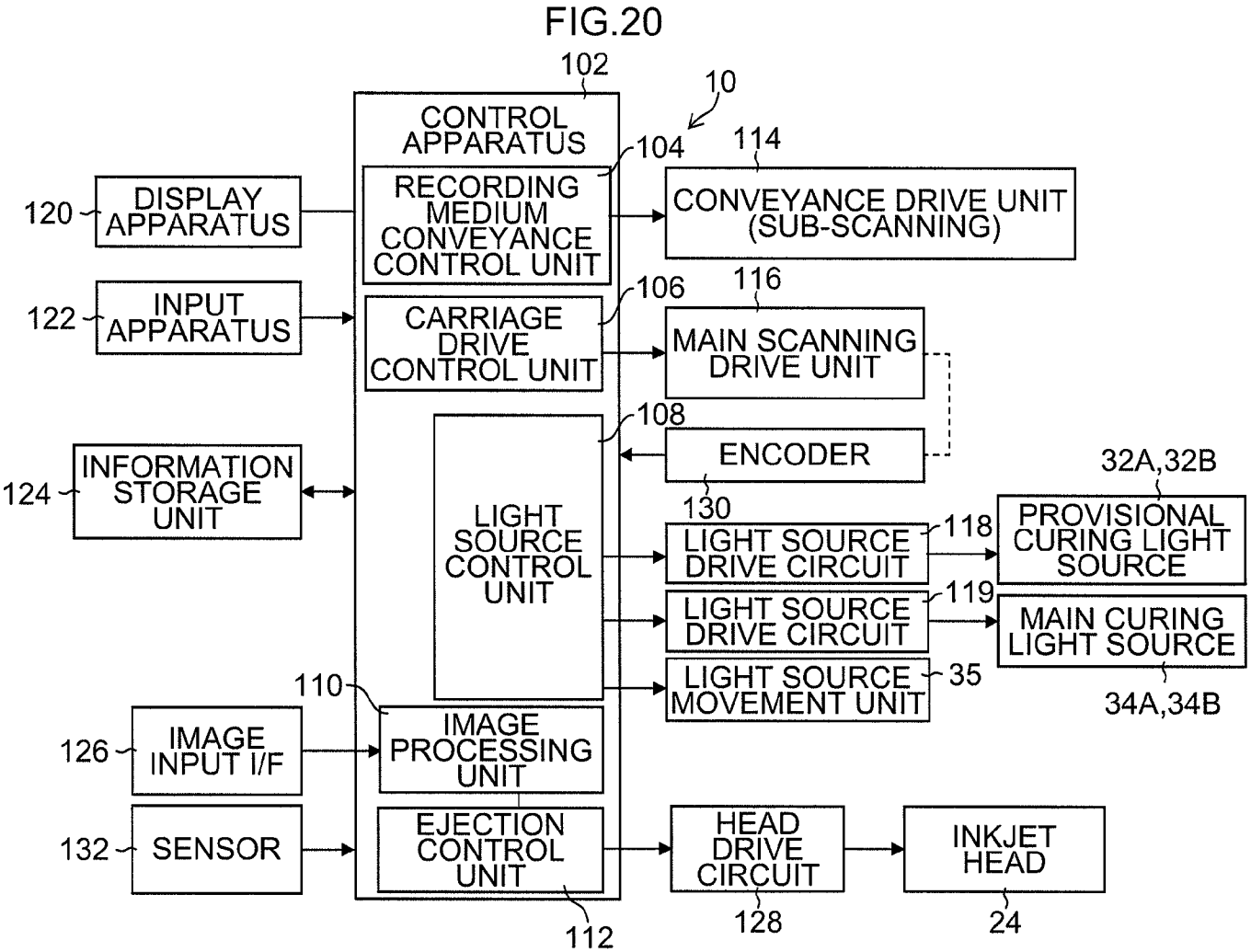
FIG. 20 is a block diagram showing an approximate configuration of the control system of the inkjet head shown in FIG. 1.

FIG. 20 is a block diagram of the composition of an inkjet recording apparatus 10. As shown in FIG. 20, a control apparatus 102 as a control device is provided in the inkjet recording apparatus 10. For this control apparatus 102, it is possible to use, for example, a computer equipped with a central processing unit (CPU), or the like. The control apparatus 102 functions as a control apparatus for controlling the whole of the inkjet recording apparatus 10 in accordance with a prescribed program, as well as functioning as a calculation apparatus for performing respective calculations. The control apparatus 102 includes a recording medium conveyance control unit 104, a carriage drive control unit 106, a light source control unit 108, an image processing unit 110, and an ejection control unit 112. These respective units are achieved by a hardware circuit or software, or a combination of these.

The recording medium conveyance control unit 104 controls the conveyance drive unit 114 for conveying the recording medium 12 (see FIG. 1). The conveyance drive unit 114 includes a drive motor which drives the nip rollers 40 40 shown in FIG. 2, and a drive circuit thereof. The recording medium 12 which has been conveyed onto the platen 26 (see FIG. 1) is conveyed intermittently in swath width units in the sub-scanning direction, in accordance with a reciprocal scanning action (printing pass action) in the main scanning direction performed by the inkjet head 24.

The carriage drive control unit 106 shown in FIG. 20 controls the main scanning drive unit 116 for moving the carriage 30 (see FIG. 1) in the main scanning direction. The main scanning drive unit 116 includes a drive motor which is connected to a movement mechanism of the carriage 30, and a control circuit thereof. The light source control unit 108 is a control device which controls light emission by the provisional curing light sources 32A and 32B via a light source drive circuit 118, as well as controlling light emission by the main curing light sources 34A, 34B via a light source drive circuit 119. UV lamps, such as UV-LED elements (ultraviolet LED elements) or metal halide lamps, are employed as the provisional curing light sources 32A, 32B and the main curing light sources 34A, 34B.

An input apparatus 120 such as an operating panel, and a display apparatus 122, are connected to the control apparatus 102. The input apparatus 120 is a device by which external operating signals are manually input to the control apparatus 102, and may employ various formats, such as a keyboard, a mouse, a touch panel, or operating buttons, or the like. The display apparatus 122 may employ various formats, such as a liquid crystal display, an organic EL display, a CRT, or the like. An operator is able to select an image formation mode, input print conditions, and input and edit additional conditions, and the like, by operating the input apparatus 120, and is able to confirm various information such as the input details and search results, via the display on the display apparatus 122.

Furthermore, an information storage unit 124 which stores various information and an image input interface 126 for acquiring image data for printing are provided in the inkjet recording apparatus 10. For the image input interface, it is possible to employ a serial interface or a parallel interface. It is also possible to install a buffer memory (not illustrated) in this portion for achieving high-speed communications.

The image data input via the image input interface 126 is converted into data for printing (dot data) by the image processing unit 110. In general, the dot data is generated by subjecting the multiple-tone image data to color conversion processing and half-tone processing. The color conversion processing is processing for converting image data represented by an sRGB system (for example, 8-bit RGB image data of each of colors of RGB) into image data of each of colors of ink used by the inkjet recording apparatus 10.

A half-toning process is processing for converting the color data of the respective colors generated by the color conversion processing into dot data of respective colors by error diffusion, a threshold value matrix, or the like. The device carrying out the half-toning process may employ commonly known methods of various kinds, such as an error diffusion method, a dithering method, a threshold value matrix method, a density pattern method, and the like. The half-toning process generally converts graduated image data having three or more tone values, into graduated image data having fewer tone values than the original number of tones. In the simplest example, the image data is converted into dot image data having 2 values (dot on/dot off), but in a half-toning process, it is also possible to perform quantization in multiple values which correspond to different types of dot size (for example, three types of dot: a large dot, a medium dot and a small dot).

The binary or multiple-value image data (dot data) obtained in this way is used for driving (on) or not driving (off) the respective nozzles, and in the case of multiple-value data, is used as ink ejection data (droplet control data) for controlling the droplet volume (dot size).

The ejection control unit 112 generates an ejection control signal for the head drive circuit 128 on the basis of dot data generated in the image processing unit 110. Furthermore, the ejection control unit 112 includes a drive waveform generation unit, which is not illustrated. The drive waveform generation unit is a device which generates a drive voltage signal for driving the ejection energy generation elements (in the present embodiment, piezo elements) which correspond to the respective nozzles of the inkjet head 24. The waveform data of the drive voltage signal is stored previously in the information storage unit 124 and waveform data to be used is output as and when required. The signal (drive waveform) output from the drive waveform generation unit is supplied to the head drive circuit 128. The signal output from the drive waveform generation unit may be digital waveform data or an analog voltage signal.

Ink is ejected from the corresponding nozzles by applying a common drive voltage signal to the ejection energy generation devices of the inkjet head 24 via the head drive circuit 128 and switching the switching elements (not illustrated) which are connected to the individual electrodes of the energy generating elements on and off in accordance with the ejection timings of the respective nozzles.

Programs to be executed by the CPU of the system controller 102 and various data required for control purposes are stored in the information storage unit 124. The information storage unit 124 stores resolution settings information, the number of passes (number of scanning repetitions), and control information for the provisional curing light sources 32A, 32B, and the main curing light sources 34A, 34B, and the like, corresponding to the image formation modes.

An encoder 130 is attached to the drive motor of the main scanning drive unit 116 and the drive motor of the conveyance drive unit 114, and outputs a pulse signal corresponding to the amount of rotation and the speed of rotation of the drive motor, this pulse signal being supplied to the control apparatus 102. The position of the carriage 30 and the position of the recording medium 12 are ascertained on the basis of the pulse signal output from the encoder 130.

The sensor 132 is installed on the carriage 30, and the width of the recording medium 12 is ascertained on the basis of the sensor signal obtained from the sensor 132.

The control apparatus 102 controls the operation of the light source movement unit 35 of the main curing light sources 34A and 34B. For example, when the image forming process selection information and the positional information about the main curing light sources 34A, 34B is input from the input apparatus 120, then the main curing light source 34A (34B) is moved to a position corresponding to the image forming process.

According to the inkjet recording apparatus and the image forming method which are composed as described above, ink which has good transmissivity of ultraviolet light, high sensitivity to ultraviolet light and a fast curing speed (color ink, clear ink) is set to a provisionally cured state by irradiating ultraviolet light of a small amount from the provisional curing light sources 32A, 32B immediately after ejection, either one of the main curing light sources 34A, 34B is moved to the ejection position of ink which has poor transmissivity of ultraviolet light (low sensitivity to ultraviolet light) and a slow curing speed (white ink), and ultraviolet light of a high amount is irradiated from the main curing light source 34A (34B) onto the ink of low sensitivity immediately after ejection, thereby curing the ink. Therefore, the amount of ultraviolet light (amount of irradiated energy) is optimized in accordance with the ink used for the image to be formed, and it is possible to form an image in which inks of two or more types having different sensitivities are superimposed on each other as layers.

More specifically, the color inks and the clear ink are set to a semi-cured state by irradiating ultraviolet light of a low amount from the provisional curing light sources 32A, 32B immediately after droplet ejection (deposition on the recording medium), and after a time for expansion of the dots has passed and the pile height has become uniform, ultraviolet light of a high amount is irradiated from the main curing light source 34B (34A) and the ink is set to a fully cured state. Consequently, a dot expansion time between provisional curing and main curing is allowed and also a time for uniformizing the pile height is allowed; therefore, it is possible to achieve a large dot gain and to improve the granularity of the image.

Furthermore, since at least one of the main curing light sources 34A and 34B is composed so as to move in parallel with the recording medium conveyance direction and can be disposed selectively at the ink ejection position for ink which has low sensitivity to ultraviolet light and a slow curing speed, and furthermore the irradiation area of the main curing light sources 34A and 34B is determined in accordance with the ejection range of the ink having low sensitivity to ultraviolet light and a slow curing speed (namely, (the total length $L_w$ of the nozzle rows/number of image forming layers (number of divisions) N), then ultraviolet light of a high amount can be irradiated selectively only onto the ink having low sensitivity to ultraviolet light and a slow curing speed, and problems caused by differences in the curing time between the inks can be avoided.

Second Embodiment

Next, a second embodiment of the present invention will be described. In the second embodiment described below, parts which are the same as or similar to the first embodiment which is described above are labeled with the same reference numerals and further explanation thereof is omitted here.

Description of Image Forming Process

Figure 21:
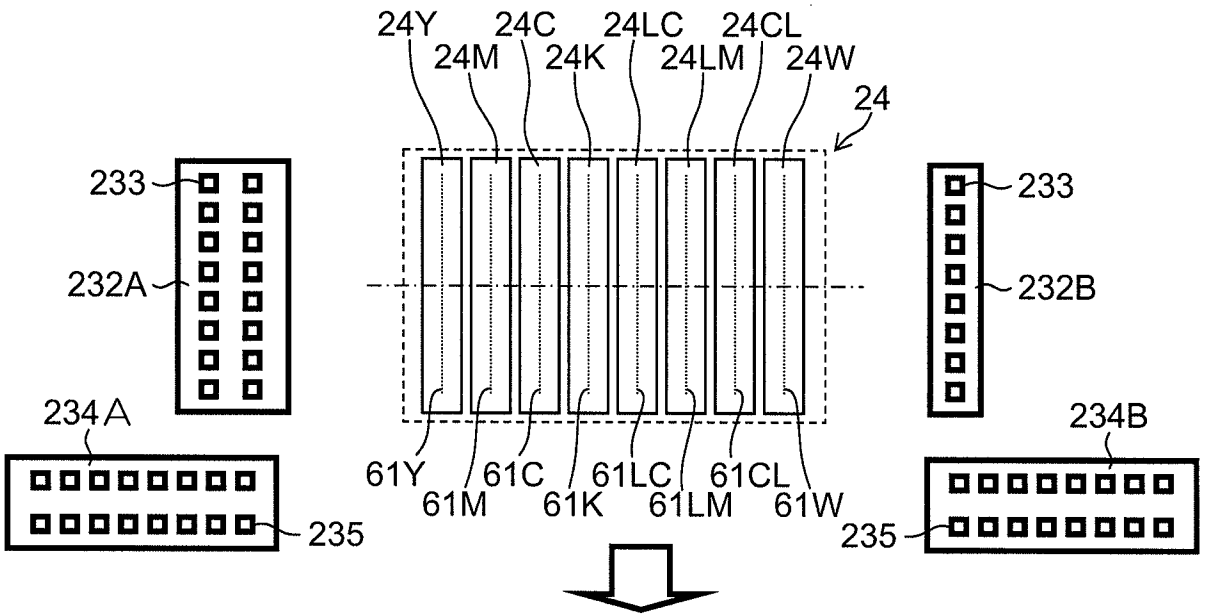
FIG. 21 is a plan view perspective diagram showing an example of the composition of an ultraviolet light irradiation unit relating to a second embodiment of the present invention.

FIG. 21 is an illustrative diagram showing the composition and arrangement of provisional curing light sources 232A and 232B and main curing light sources 234A and 234B relating to the second embodiment. The provisional curing light sources 232A and 232B shown in FIG. 21 have at least one row of UV-LED elements in which UV-LED elements 233 of a number corresponding to the maximum number of image forming layers $N_{max}$ are arranged in the recording medium conveyance direction.

In the example shown in FIG. 21, the provisional curing light source 232A on the left-hand side in FIG. 21 has a structure in which two UV-LED element rows, each composed by eight UV-LED elements 233, are arranged in the scanning direction, and the provisional curing light source 232B on the right-hand side in FIG. 21 has one row of LED elements composed by eight UV-LED elements 233.

The on/off switching and amount of emitted light of the UV-LED elements 233 are controlled independently (individually), and therefore the UV-LED elements 233 are switched on and off selectively and the amount of emitted light is adjusted independently (individually), in accordance with the curing characteristics of the ink. The main curing light sources 234A, 234B which are provided on the downstream side of the inkjet head 24 in the recording medium conveyance direction have a structure in which a plurality of UV-LED elements 235 are aligned in the scanning direction and the recording medium conveyance direction. The on/off switching and the amount of irradiated light of the UV-LED elements 235 which are provided in the main curing light sources 234A and 234B can be controlled independently (individually).

Figure 22:
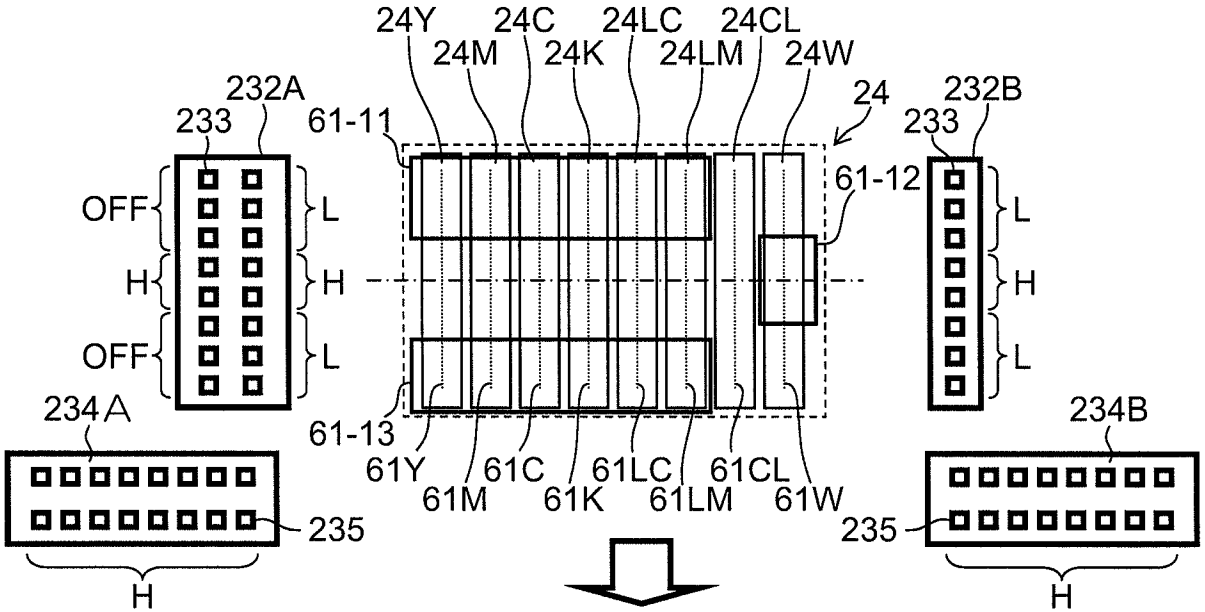
FIG. 22 is an illustrative diagram showing a schematic view of the control of light emission by the LED elements of the ultraviolet light irradiation unit.

FIG. 22 is an illustrative diagram showing a schematic view of the control of irradiation by the provisional curing light sources 232A, 232B and the main curing light sources 234A, 234B in a case where an image is formed which has a structure in which a color image layer 82-1, a white base layer 80 and a color image layer 82-2 are layered sequentially on a transparent recording medium 12 (see, FIG. 11, the case where the number of image forming layers is three). In FIG. 22, the UV-LED elements 233 which emit light at a maximum light emission amount are marked "H", the UV-LED elements 233 which emit light at a medium light emission amount are marked "L", and the UV-LED elements 233 which do not emit light are marked "OFF".

Step 1 is a step of forming a color image layer 82-1, in which the carriage 30 is caused to perform a scanning action in the carriage movement direction and color inks are ejected onto the recording medium 12 from the upstream region 61-11 of the nozzle rows 61Y, 61M, 61C, 61K, 61LC, 61LM. Furthermore, the UV-LED elements 233 of the provisional curing light source 232A which follows the upstream region 61-11 of the nozzle rows 61Y, 61M, 61C, 61K, 61LC, 61LM (the first, second and third UV-LED elements from the top of the right-hand row) and the UV-LED elements 233 of the provisional curing light source 232B (the first, second and third UV-LED elements from the top) emit light at a medium light emission amount, and ultraviolet light of a low amount (1 to 5 mJ/cm$^2$ per scanning action) is irradiated onto the color ink immediately after landing on the recording medium 12, thereby provisionally curing the ink and setting the ink to a gel state. In so doing, landing interference of the color inks is prevented.

Step 2 is the time period from the step of forming the color image layer 82-1 until the step of forming the white base layer 80, and by maintaining the semi-cured state for a prescribed period of time, adhesion of the color image layer 82-1 (see FIG. 11) and the recording medium 12 is improved, and spreading of the dots and reduction of the pile height are promoted.

Step 3 is a step of forming a white base layer 80, in which the carriage 30 is scanned in the carriage movement direction, and white ink is ejected onto the color image layer 82-1 which is in a semi-cured state, from the central region 61-12 of the nozzle row 61W only. The UV-LED elements 233 (the fourth and fifth LED elements from the top of both the left and right-hand rows) of the provisional curing light source 232A following the central region 61-12 of the nozzle row 61W and the UV-LED elements 233 (the fourth and fifth LED elements from the top) of the provisional curing light source 232B emit light at the maximum light emission amount, whereby ultraviolet light of a high amount (not less than 10 mJ/cm$^2$ per scanning action) is irradiated onto the white ink immediately after landing on the recording medium 12 and the color image layer 82-1 in a semi-cured state below the white ink, and a white base layer 80 having a substantially cured state is formed (see FIG. 11).

Step 4 is a step of forming a color image layer 82-2, and at an ejection position of the color ink which is at a distance ($L_w$/3) further to the downstream side in the recording medium conveyance direction from the white ink ejection position on the recording medium 12, the carriage 30 is made to perform a scanning action in the carriage movement direction and color inks are ejected onto the white base layer 80 from the downstream region 61-13 of the nozzle rows 61Y, 61M, 61C, 61K, 61LC, 61LM. Furthermore, the UV-LED elements 233 of the provisional curing light source 232A which follows the downstream region 61-13 of the nozzle rows 61Y, 61M, 61C, 61K, 61LC, 61LM (the sixth to eighth UV-LED elements 233 from the top of the right-hand row) and the UV-LED elements 233 of the provisional curing light source 232B (the sixth to eighth UV-LED elements from the top) emit light at a medium light emission amount, and ultraviolet light of a low amount (1 to 5 mJ/cm$^2$ per scanning action of the carriage) is irradiated onto the color ink immediately after landing on the recording medium 12, thereby provisionally curing the ink and setting the ink to a gel state. In so doing, landing interference of the color inks is prevented. By maintaining the provisional curing state for a prescribed period of time, spreading of dots and reduction of the pile height are promoted.

Step 5 is the time from the step of forming a color image layer 82 to the main curing process step, during which UV-LED elements 235 of the main curing lights 234A and 234B arranged on the downstream side of the inkjet head 24 in terms of the recording medium conveyance direction emit light at a maximum light emission amount, thereby irradiating ultraviolet light of a high amount (not less than 10 mJ/cm$^2$ per scanning action of the carriage) and performing a main curing process on the color image layers 82-1, 82-2, and the white base layer 80 which is sandwiched between the two color image layers 82-1 and 82-2. By performing main curing of the color image layers 82-1 and 82-2 and the white base layer 80, then the glossiness of the color image layers 82-1 and 82-2 is improved, and the adhesion between the recording medium 12 and the color image layer 82-1 and the adhesion between the color image layers 82-1 and 82-2 and the white base layer 80 are improved, as well as hardening the color image layers 82.

One possible method of altering the amount of light emitted with respect to each of UV-LED elements is a method which employs PWM control of the drive waveform of the UV-LED elements to control the duty of the lighting drive waveform, a method which reduces the operating current, or on/off control, and so on. The amount of light emitted by each of the UV-LED elements can be controlled in this way by the light source drive circuits 118 and 119 shown in FIG. 20.

In the second embodiment which is described above, a desirable mode is one in which, when the mode of the image to be formed (layer forming mode) has been decided, the amount of light emitted by the UV-LED elements 235 of the main curing light source 34A (the current value supplied to the UV-LED elements) is controlled automatically.

The number and arrangement of the UV-LED elements 233 of the provisional curing light source 232A and the provisional curing light source 232B given in the present embodiment are merely examples and can be modified as appropriate. For example, the same number and arrangement of UV-LED elements 233 can be used in the provisional curing light sources 232A and 232B.

Modification Examples

Figure 23:
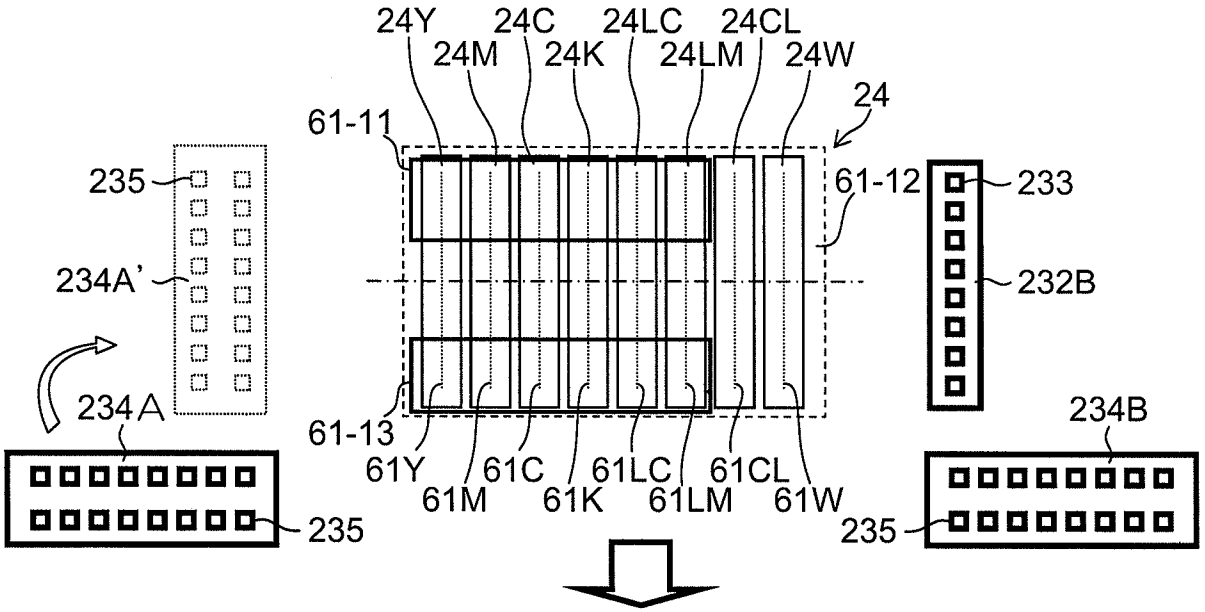
FIG. 23 is an illustrative diagram showing a further example of the composition of the ultraviolet light irradiation unit shown in FIG. 21.

FIG. 23 is a schematic drawing of a modification example relating to the second embodiment of the invention. The modification example shown in FIG. 23 combines the main curing light source 234A and the provisional curing light source 232A. In other words, the provisional curing light source 232A shown in FIG. 21 is omitted, and the main curing light source 234A is moved in the recording medium conveyance direction, as well as being rotated in a plane parallel to the surface on which the nozzles are formed (nozzle surface) so as to be disposed at the position of the provisional curing light source 232A (indicated by the dotted line and labeled with reference numeral 234') in such a manner that the arrangement of UV-LED elements 233 is the same.

According to this modification example, it is possible to reduce the overall number of UV-LED elements mounted on the carriage 30, as well as being able to make the drive circuits (light source drive circuits 118, 119) of the UV-LED elements small in size, and also to make the carriage 30 more compact.

Third Embodiment

Figure 24:
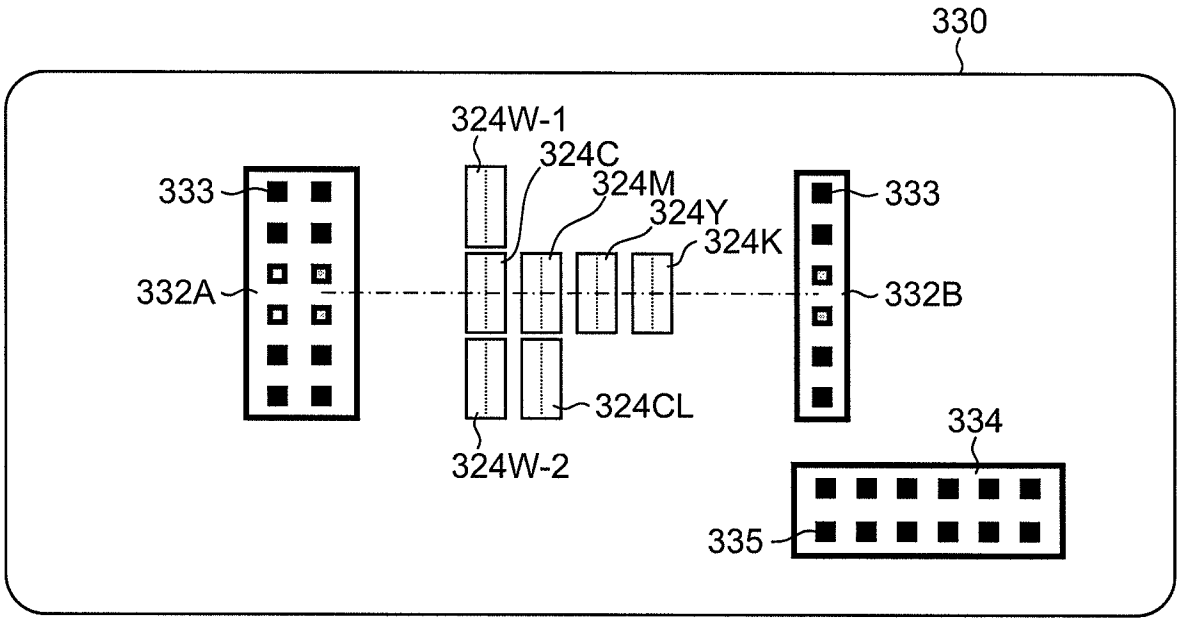
FIG. 24 is an oblique perspective diagram showing the composition of the inkjet head relating to a third embodiment of the present invention and an example of the composition of an ultraviolet light irradiation unit.

Arrangement of the Inkjet Head, the Provisional Curing Light Sources and the Main Curing Light Sources Next, a third embodiment of the present invention will be described. FIG. 24 is an illustrative diagram showing the composition and arrangement of an inkjet head 324 relating to a third embodiment of the invention, and the composition and arrangement of the provisional curing light sources 332A, 332B and the main curing light source 334.

In the inkjet head 324 shown in FIG. 24, a W head 324W-1 having a nozzle row 361W-1 which ejects white ink is arranged on the furthest upstream side in terms of the recording medium conveyance direction, and in adjacent positions to the downstream side of the W head 324W-1 in the recording medium conveyance direction, a C head 324C having a nozzle row 361C which ejects cyan ink, an M head 324M having a nozzle row 361M which ejects magenta ink, a Y head 324Y having a nozzle row 361Y which ejects yellow ink, and a K head 324K having a nozzle row 361K which ejects black ink, are arranged.

The C head 324C, the M head 324M, the Y head 324Y and the K head 324K are arranged in alignment in the carriage movement direction, and the C head 324C is disposed so as to correspond to the position of the W head 324W-1 in the carriage movement direction.

Moreover, a W head 324W-2 having a nozzle row 316W-2 which ejects white ink and a CL head 324CL having a nozzle row 361CL which ejects clear ink are arranged at adjacent positions to the downstream side of the C head 324C, the M head 324M, the Y head 324Y and the K head 324K in the recording medium conveyance direction, in addition to which the W head 324W-2 and the CL head 324CL are arranged in the carriage movement direction. The W head 324W-2 is arranged so as to correspond to the position of the C head 324C in the carriage movement direction. More specifically, the W head 324W-1, the C head 324C and the W head 324W-2 are disposed in alignment in the recording medium conveyance direction.

Furthermore, provisional curing light sources 332A, 332B are provided on either side of the inkjet head 324 in the carriage movement direction, and the provisional curing light sources 332A, 332B have a structure in which a plurality of UV-LED elements 333 are arranged so as to correspond to the arrangement of the inkjet head 324 (nozzle row 361). Moreover, a main curing light source 334 in which a plurality of UV-LED elements 335 are arranged in a two-dimensional configuration are provided on the downstream side of the inkjet head 324 in terms of the recording medium conveyance direction. The inkjet head 324, the provisional curing light sources 332A, 332B and the main curing light source 334 which are arranged in this way are mounted as a single body on the carriage 330.

Image Forming Process

The image forming process using the composition shown in FIG. 24 employs the image forming process shown in the first specific example to the fifth specific example of the first embodiment, and the light emission control of the provisional curing light sources and the main curing light sources shown in the second embodiment. For example, if forming an image comprising two layers as shown in FIG. 5, a white base layer 80 is formed by ejecting to white ink using the nozzle row 361W-1 and controlling the UV-LED elements 333 of the provisional curing light source 332A so as to irradiate ultraviolet light of a high amount onto the white ink immediately after landing on the recording medium 12 (see FIG. 1), and a color image layer 82 is formed by ejecting color inks onto the white base layer 80 by using nozzle rows 361C, 361M, 361Y and 361K and controlling the UV-LED elements 333 of the provisional curing light source 332A so as to irradiate ultraviolet light of a low amount onto the color inks immediately after landing on the recording medium 12.

For the images shown in FIGS. 7, 9, 11 and 13, the nozzle rows 361W-1, 361W-2, 361CL and the nozzle rows 361C, 361M, 361Y and 361K can be used appropriately and light emission by the UV-LED elements 333 of the provisional curing light source 332A and the UV-LED elements 335 of the main curing light source 334 can be controlled appropriately in accordance with the type of ink.

Fourth Embodiment

Next, a fourth embodiment of the present invention will be described.

Compositional Example 1 of Provisional Curing Light Source

Figure 25:
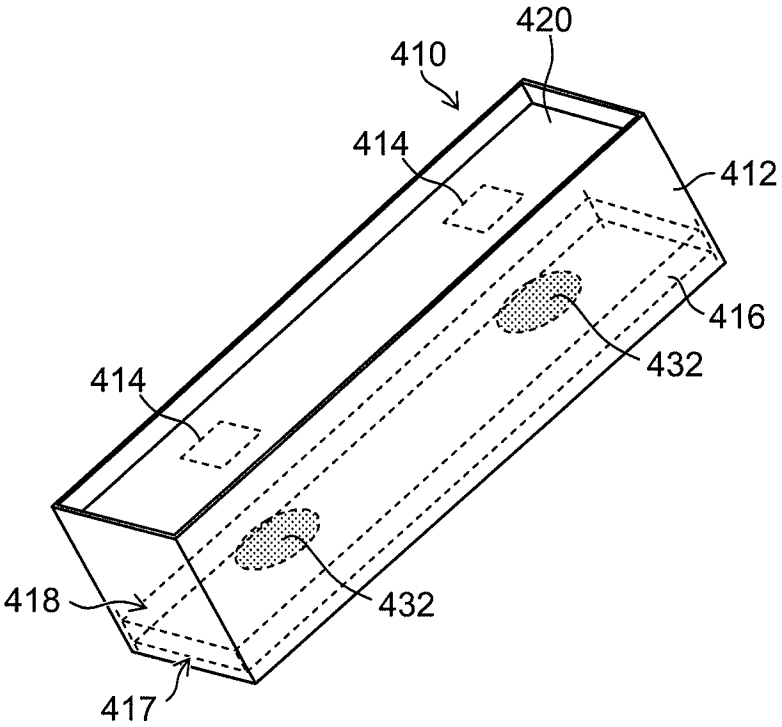
FIG. 25 is an oblique perspective diagram showing an example of the composition of an ultraviolet light irradiation unit relating to a fourth embodiment of the present invention.

FIG. 25 is a perspective diagram showing an example of the composition of a provisional curing light source 410. As shown in FIG. 25, the provisional curing light source 410 according to the present example has a substantially rectangular parallelepiped box shape. The provisional curing light source 410 has a structure in which ultraviolet light-emitting diode (UV-LED) elements 414 are accommodated in an aluminum housing (surround) 412 and a transmissive light diffusion plate 416 is provided on the bottom face of the housing 412. The wiring substrate 420 on which the UV-LED elements 414 are mounted is arranged in the upper portion of the housing 412 in a state where the LED mounting surface is facing toward the light diffusion plate 416.

Desirably, the number of UV-LED elements 414 which are installed on the wiring substrate 420 is as small as possible, from the viewpoint of costs and the required UV irradiation width. In the present example, two UV-LED elements 414 are provided on the wiring substrate 420. In order to obtain a UV irradiation width which enables UV light to be irradiated simultaneously in accordance with the whole length $L_w$ of the nozzle row 61 following the recording medium conveyance direction (X direction) in the inkjet head 24 to shown in FIG. 3, two UV-LED elements 414 are arranged in alignment in the recording medium conveyance direction.

The length $L_u$ of the LED element row in which the plurality of (here, two) UV-LED elements 414 are arranged in the X direction (the width of the LED element row) is shorter than the whole length $L_w$ of the nozzle row 61 of the inkjet head 24 ($L_u<L_w$).

A metal substrate having enhanced heat radiating properties and thermal resistance is used for the wiring substrate 420. The detailed structure of the metal substrate is not shown, but the insulating layer is formed on a metal plate made of aluminum and copper, and UV-LED elements 414 and wiring circuits for driving the LEDs (anode wires, cathode wires), and the like, are formed on top of the insulating layer. It is also possible to use a metal base substrate having a circuit formed on a base metal, or a metal core substrate in which a metal plate is embedded inside a substrate.

Furthermore, a white resist which is resistant to UV light and has high reflectivity is provided about the periphery of the UV-LED elements 414 on the LED mounting surface of the wiring substrate 420. By means of this white resist layer (not illustrated), it is possible to reflect and scatter ultraviolet light on the surface of the wiring substrate 420, and hence the light emitted from the UV-LED elements 414 can be used very efficiently for UV irradiation for the purpose of provisional curing.

The light diffusion plate 416 is a milk-white colored plate which is made from an optical material that transmits and diffuses light emitted from the UV-LED elements 414. For example, the light diffusion plate 416 employs a white acrylic plate in which a white pigment (light scattering material) is dispersed. The light diffusion plate is not limited to such a white acrylic plate, and it is also possible to use an optical member formed by mixing and dispersing fine particles for light diffusion in a transparent material, such as glass. Optical diffusion plates having different transmissivities and diffusion characteristics are obtained by varying the content of light diffusing material (white pigment, etc.)

The transmissive light diffusion plate which diffuses the light is not limited to a plate in which a silica powder is dispersed in an acrylic resin, and can also be achieved easily by applying a frosting treatment, an obscure glass treatment (fogged glass treatment), or a ground glass treatment to the surface of a substrate made from molten quartz.

Figure 26:
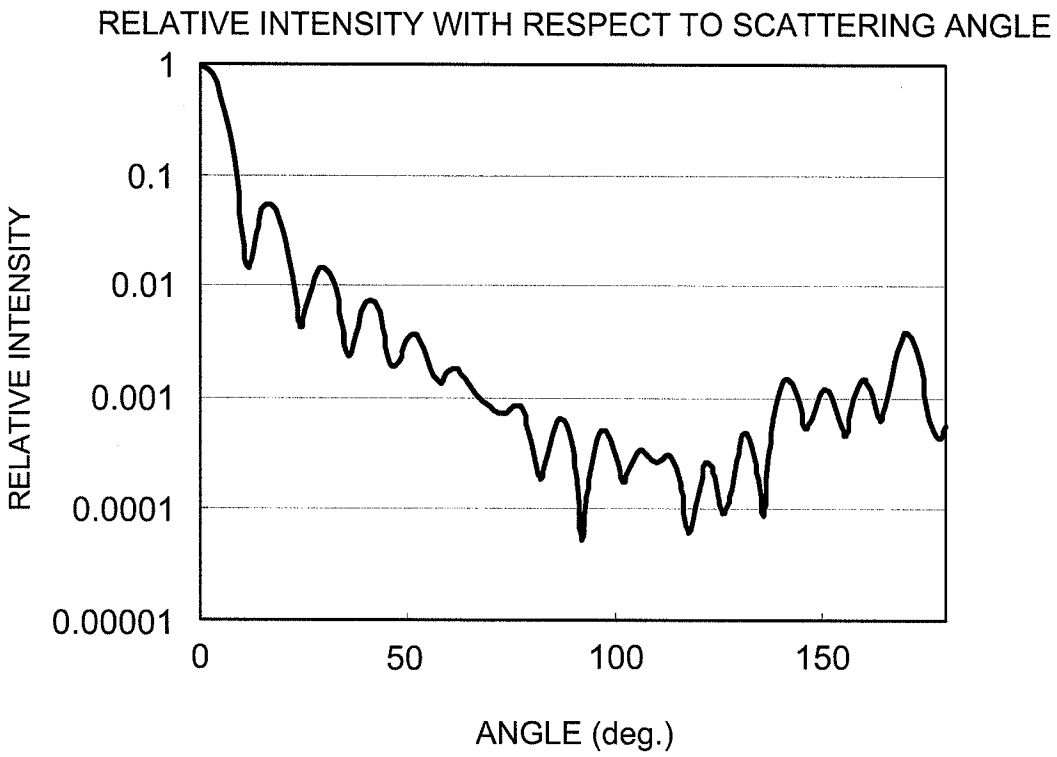
FIG. 26 is a graph showing the Mie scattering characteristics of a light diffusion plate.

The light diffusion plate 416 having diffusion properties as shown in FIG. 26 is arranged in the lower portion of the housing 412, so as to oppose the LED mounting surface of the wiring substrate 420. In FIG. 25, the lower surface of the light diffusion plate 416 is a light emission surface 417 which opposes the recording medium. The light diffused by the light diffusion plate 416 is irradiated from the light emission surface 417 onto the recording medium through a light irradiation width equal to or greater than the nozzle row width $L_w$ of the inkjet head 24.

The upper surface of the light diffusion plate 416, in other words, the surface opposite to the light emission surface 417 of the light diffusion plate 416 (the surface opposing the UV-LED elements 414) is the light entrance surface 418 to the light diffusion plate 416. A mirror 432 (reflecting section) for reflecting and scattering the direct incident light of the UV-LED elements 414 is coated onto the light entrance surface 418 of the light diffusion plate 416, at a position opposing each UV-LED element 414. The UV-LED elements 414 and the mirrors 432 are arranged in corresponding positions so as to face each other inside the housing 412.

The housing 412 of the provisional curing light source 410 is composed from plate metal of aluminum (untreated), and the inner circumferential surface of the housing 412 functions as a side face reflecting plate. A polishing treatment or white coating, or the like, may be provided on the inner circumferential surface of the housing 412 in order to raise the reflectivity.

According to the provisional curing light source 410 having a composition of this kind, light emitted from the UV-LED element 414 is reflected and scattered by the mirror 432 of the light diffusion plate 416 and reflected and scattered by the inner circumferential surface (side face reflecting plate) of the mirror 432 and the housing 412 and the white resist layer of the wiring substrate 420, and the like, and enters into the light diffusion plate 416. The light which has entered from the light entrance surface 418 of the light diffusion plate 416 is diffused upon passing through the light diffusion plate 416 and is irradiated from the light emission surface 417 toward the recording medium.

Figure 27:
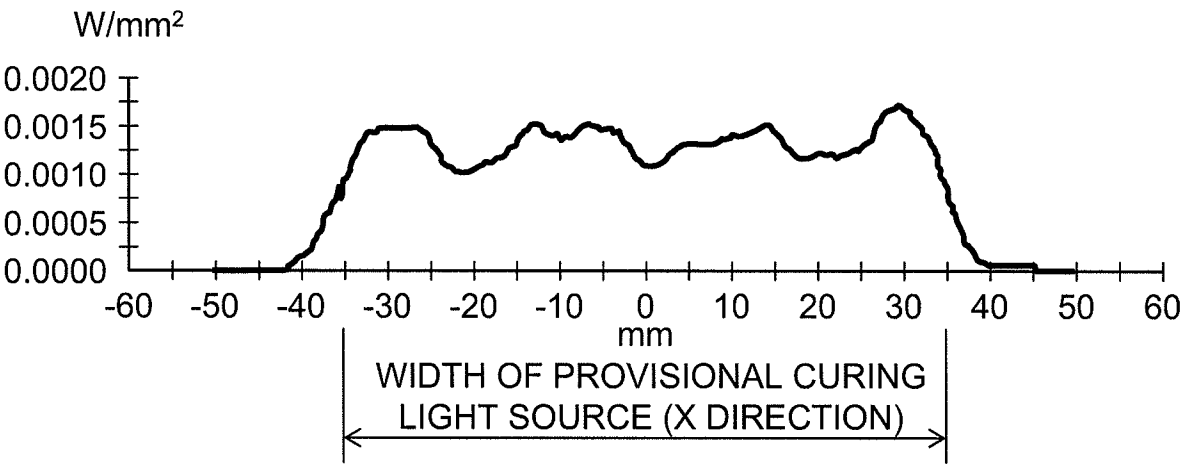
FIG. 27 is a graph showing the illumination distribution (X direction) of ultraviolet light irradiated from a provisional curing light source.
Figure 28:
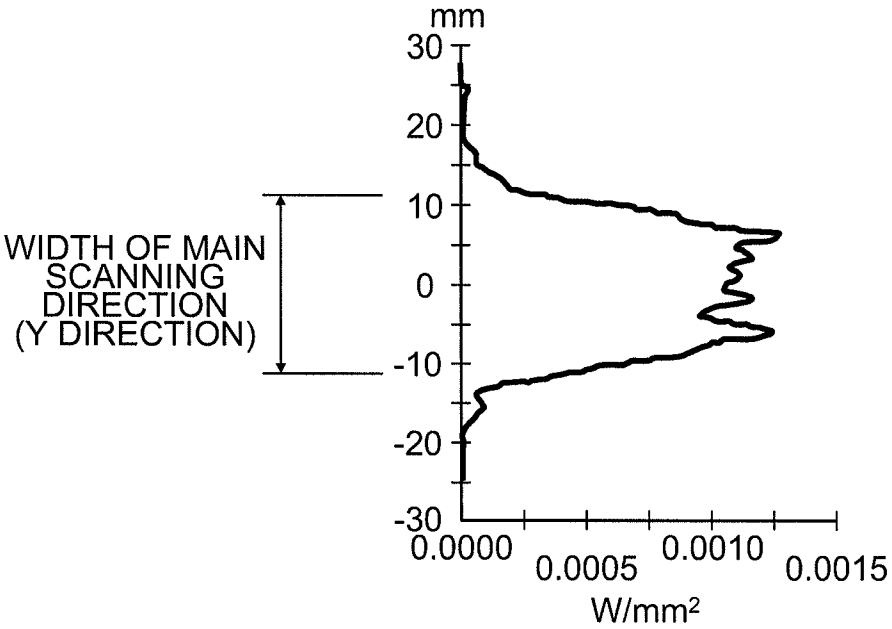
FIG. 28 is a graph showing the illumination distribution (Y direction) of ultraviolet light irradiated from a provisional curing light source.

FIG. 27 and FIG. 28 are graphs showing the illumination distribution of ultraviolet light irradiated from the provisional curing light source 410. FIG. 27 shows the illumination distribution in the Y direction on the recording medium, and FIG. 28 shows the illumination distribution in the X direction on the recording medium.

The light emission surface 417 of the provisional curing light source 410 relating to the present embodiment has an X-direction width of approximately 70 mm and a Y-direction width of approximately 12 mm. As shown in FIG. 27 and FIG. 28, the light which has passed through the light diffusion plate 416 is diffused into an almost uniform illumination distribution and irradiated in this state. According to the provisional curing light source 410 of the present example, a light irradiation width of a length equal to or greater than the total length $L_w$ of the nozzle row 61 is achieved although a composition which employs a small number of (here, two) UV-LED elements 414 ($L_u<L_w$) are used.

According to the present embodiment, it is possible efficiently to produce an illumination distribution having a light irradiation width equal to or greater than the nozzle row which is suitable for provisional curing, although a small number of UV-LED elements are used.

Swath Width by Singling Scans

In the image formation mode of a wide-format machine, the image formation conditions for singling (interlacing) are determined with respect to each of different resolution settings. More specifically, since image formation by singling is carried out by dividing the width $L_w$ of the ejection nozzle row of the inkjet head by the number of passes (number of scanning repetitions), then the swath width varies with the nozzle row width of the inkjet head and the number of passes in the main scanning direction and the sub-scanning direction (the number of interlaced divisions). The details of singling image formation based on a multi-pass method are described in Japanese Patent Application Publication No. 2004-306617, for example.

For instance, the relationship between the number of passes and the swath width in singling image formation when using a FUJIFILM Dimatix QS-10 head (manufactured by FUJIFILM Dimatix, Inc.) are as shown in Table 1 below. The envisaged swath width during image formation is a value obtained by dividing the width of the nozzle row used by the product of the number of passes in the main scanning direction and the number of passes in the sub-scanning direction.

TABLE 1

| | Width of the nozzle row used (mm) | | | |
|---|---|---|---|---|
| | 64.8 | 64.8 | 64.8 | 64.8 |
| Number of passes in the main scanning direction | 1 | 1 | 2 | 2 |
| Number of passes in the sub-scanning direction | 2 | 4 | 2 | 4 |
| Swath width (mm) | 32.4 | 16.2 | 16.2 | 8.1 |

Compositional Example 2 of Provisional Curing Light Source

Figure 29:
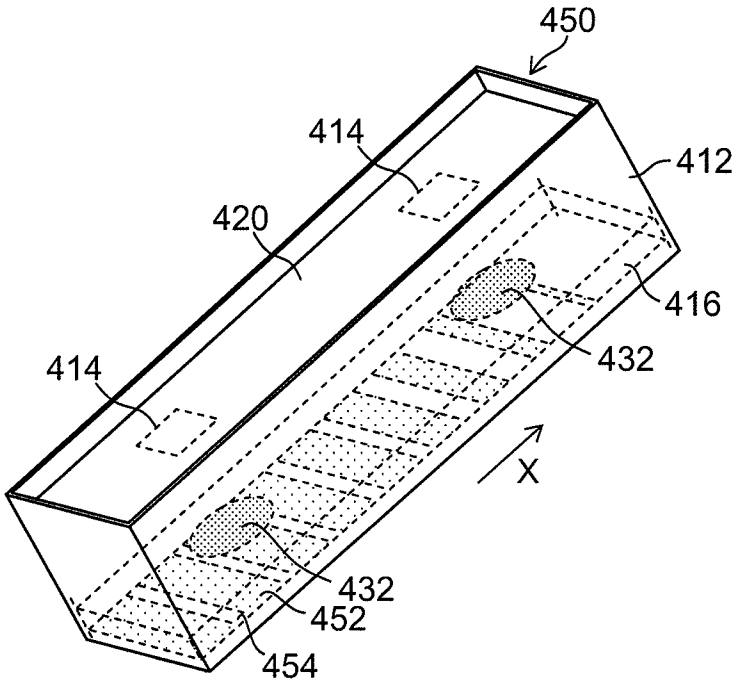
FIG. 29 is a perspective diagram showing a further example of the composition of a provisional curing light source.

As described previously, in the case of a printing method in which ultraviolet light exposure is carried out while ejecting droplets from nozzle rows in a singling scanning operation, one swath includes ink droplets which have received a large number of cumulative exposures and inks droplets which have received a small number of cumulative exposures. From the viewpoint of improving fluctuation in the total amount of exposure due to differences in the number of exposures, it is desirable to improve the irradiation distribution of the provisional curing light source and to apply an illumination distribution in the medium conveyance direction whereby the intensity of illumination increases toward the downstream side of the nozzle rows. FIG. 29 is an example of the composition of a provisional curing light source 450 which achieves an illumination distribution of this kind. In FIG. 29, elements which are the same as or similar to the provisional curing light source 410 described above are labeled with the same reference numerals and further explanation thereof is omitted here.

In the provisional curing light source 450 shown in FIG. 29, band-shaped reflecting sections (reflective mirror) 452 are formed by a mirror coating on the light emission surface 417 of the light diffusion plate 416. The bands of the reflective mirror 452 are arranged in such a manner that the intensity of illumination becomes greater, the further the position toward the downstream side of the medium conveyance direction.

The bands of the reflective mirror 452 gradually become wider (X-direction width) toward the upstream side in the medium conveyance direction and gradually become narrower toward the downstream side. The portions corresponding to the reflective mirror 452 do not transmit light and light is irradiated from the portions where the reflective mirror 452 is not present (indicated by reference numeral 454).

More specifically, the light which reaches a portion of the reflective mirror 452, of the light arriving at the light emission surface 417 of the light diffusion plate 416, is reflected by the reflective mirror 452 and returns through the light diffusion plate 416. On the other hand, the light which arrives at a portion where the reflective mirror 452 is not present (the light transmission portions 454 between the bands of the reflective mirror 452), of the light which arrives at the light emission surface 417 of the light diffusion plate 416, exits to the exterior of the light diffusion plate 416 via the light transmission portions 454. The change in the width of the bands of the reflective mirror 452 on the light emission surface 417 of the light diffusion plate 416 is designed on the basis of a certain polynomial expression, so as to obtain a desired illumination distribution. The width of the light transmission portions 454 (X-direction width) where the reflective mirror 452 is not coated becomes broader toward the downstream side of the medium conveyance direction, and an illumination distribution is achieved in which the brightness becomes greater toward to the downstream side.

Figure 30:
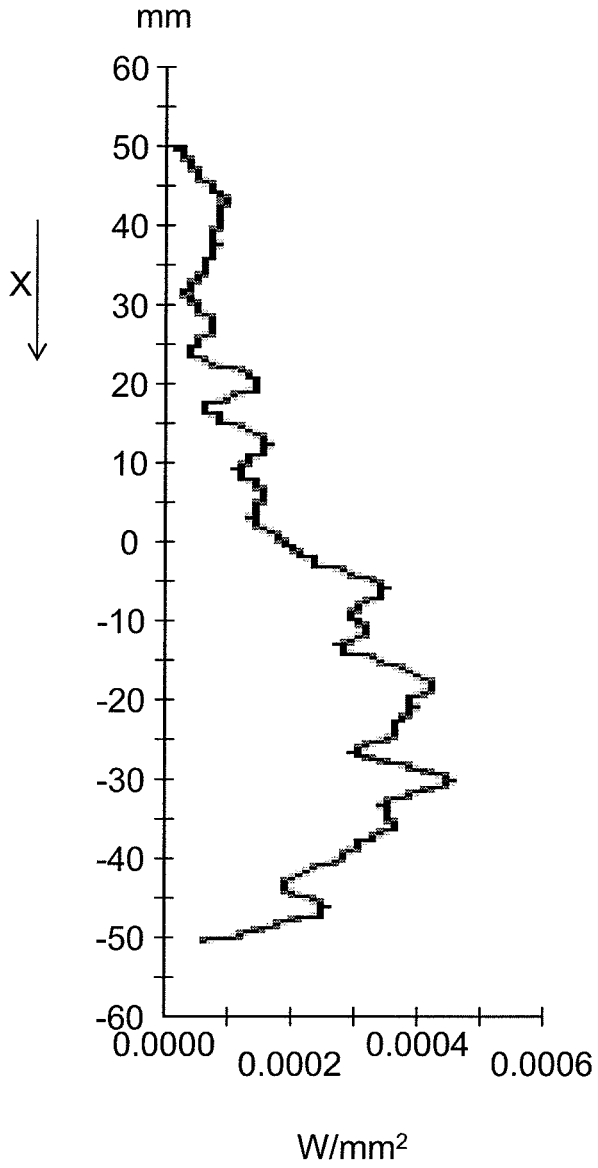
FIG. 30 is a graph showing an illumination distribution (X direction) of the provisional curing light source described in FIG. 29.
Figure 31:
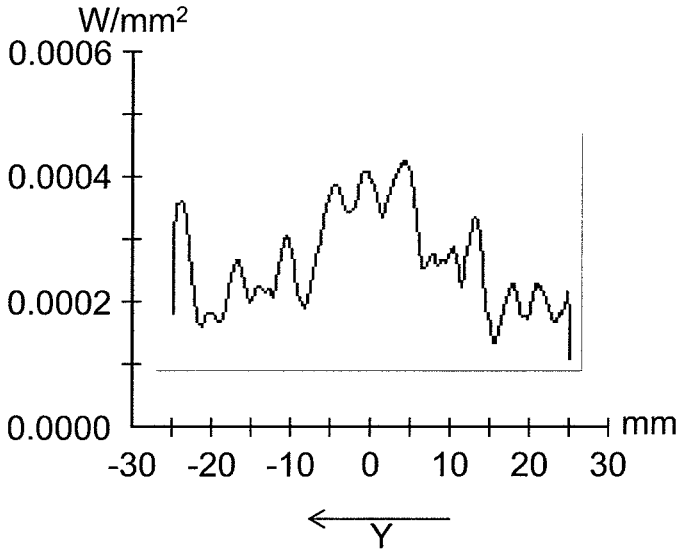
FIG. 31 is a graph showing an illumination distribution (Y direction) of the provisional curing light source described in FIG. 29.

FIG. 30 is a graph showing the illumination distribution in the medium conveyance direction (X direction) of a provisional curing light source 450 shown in FIG. 29, and FIG. 14 shows a cross-section of the illumination distribution in the Y direction. These show a distribution on the center lines of the irradiation area on the medium surface (the center line in the Y-direction and the center line in the X-direction). As shown in FIG. 30, a distribution is obtained in which the illumination intensity increases toward the downstream side in the medium conveyance direction. In the present example, based on this principle, a distribution is obtained in which an illumination intensity peak corresponds to an irradiation area on the white ink.

In order to enable adjustment of the amount of light and the illumination distribution of the provisional curing light source in this way, a composition is adopted in which the light diffusion plate 416 of the provisional curing light source is replaceable. Light diffusion plates 416 of a plurality of types having different diffusion transmissivities and different distributions of the reflective mirror 452 in the light emission surface 417 are prepared in advance, and the light diffusion plate 416 is switched in accordance with the recording medium used and the image formation mode.

For example, a light diffusion plate having a lower transmissivity is used, the higher the surface reflectivity of the recording medium used. Furthermore, light diffusion plates each having a distribution of the reflective mirror 452 which achieves a suitable illumination distribution are prepared in advance for the image formation modes respectively, and an operator (printer user) carries out a task of changing to a corresponding light diffusion plate, in accordance with the image formation mode for printing.

In order to facilitate the task of switching the light diffusion plate 416, an installation structure for installing the light diffusion plate 416 removably is provided in the lower portion of the housing 412. More specifically, for example, grooves for supporting the edges of the light diffusion plate 416 are formed in a light diffusion plate installation section of the housing 412, and a light diffusion plate 416 is set in place by inserting the light diffusion plate 416 to along the grooves. When replacing a light diffusion plate 416, the light diffusion plate 416 set in position is pulled out and another light diffusion plate is inserted. The installation structure is not limited to a pull-out system in this way, and it is also possible to employ various installation structures, such as a structure where the plates are installed and removed by using the engagement of hooks, or a structure where the plates are installed and removed by using the engagement of projections and recesses.

Furthermore, it is also possible to adopt a composition in which the provisional curing light source including the light diffusion plate is changed, rather than changing the light diffusion plate only. In this case, provisional curing light sources of a plurality of types corresponding to the recording media used and the image formation modes are prepared in advance, and an operator (printer user) carries out a task of switching it to a corresponding provisional curing light source in accordance with the type of recording medium used or the image formation mode during printing.

By properly switching the light diffusion plate or the provisional curing light source including the light diffusion plate, the light amount distribution for provisional curing can be adjusted and it is possible to irradiate ultraviolet light of a high amount, only onto an ejection region of slow-curing ink which has low sensitivity with respect to ultraviolet light.

In the present embodiment, an example is given in which the ultraviolet light is used as an active light beam for curing ink, but it is also possible to use a light beam having a wavelength band other than ultraviolet light as the active light beam. More specifically, the active light beam which cures ink can employ a light beam of a wavelength band which is capable of irradiating the energy required to cure ink. Furthermore, it is also possible to use active light beams having different wavelength bands in the main curing light sources and the provisional curing light sources respectively. For example, the provisional curing light sources can employ light sources which irradiate an amount of energy for curing the ink to the extent of suppressing movement of the ink and which generate lower active energy than the main curing light source. On the other hand, the main curing light source employs a light beam capable of generating an active energy which is higher than the provisional curing light source.

Inkjet recording apparatuses and image forming methods to which the present invention is applied have been described in detail above, but suitable modifications are possible in a range which does not depart from the essence of the present invention.

APPENDIX

As has become evident from the detailed description of the embodiments given above, the present specification includes disclosure of various technical ideas including aspects of the invention described below.

One aspect of the invention is directed to an inkjet recording apparatus comprising: an image forming device including nozzle rows which are provided to correspond to inks that are curable by irradiation of an active light beam and have different curing characteristics respectively, and which have nozzles arranged for ejecting the inks; a relative movement device which causes relative movement between the nozzle rows and a recording medium on which the inks ejected from the nozzles are deposited; an ejection control device which controls ink ejection from the image forming device with respect to each of divided units obtained by dividing the nozzle rows into a plurality of units, so as to form layers on the recording medium by the inks ejected from the respective divided units in such a manner that the layers that are formed by the inks ejected from the different divided units are superimposed on each other; an active light beam irradiation device which irradiates the active light beam onto the inks that have been ejected onto the recording medium; and an irradiation light amount variation device which is capable of varying an amount of irradiation light from the active light beam irradiation device, in accordance with the curing characteristics of the inks in the respective layers on the recording medium.

According to this aspect of the invention, since the irradiation light amount of an active light beam is varied with respective to each of inks in accordance with differences in the curing characteristics (active light beam absorption characteristics) of the inks, then it is possible to obtain a desirable curing state for each ink, and a layer formed by ink which has relatively high sensitivity to the active light beam and which has a fast curing speed and a layer formed by ink which has relatively low sensitivity to the active light beam and which has a slow curing speed can be superimposed on each other.

For this aspect of the invention, it is possible to adopt a mode in which an active light beam having a relatively larger amount of light is irradiated onto ink which has lowest sensitivity to the active light beam and a slowest curing speed.

Desirably, the relative movement device includes: a first relative movement device which causes relative movement between the image forming device and the recording medium in a first direction along a direction of arrangement of the nozzle rows; and a second relative movement device which causes relative movement between the image forming device and the recording medium in a second direction which is perpendicular to the first direction, and the irradiation light amount variation device causes movement in the second direction in an outside of the nozzle rows in the first direction, in accordance with the curing characteristics of the inks in such a manner that an irradiation range of the active light beam irradiation device corresponds to an ejection position of the ink which has relatively low sensitivity with respect to the active light beam and has a slow curing speed.

According to this mode, since the active light beam irradiation device is moved in such a manner that the irradiation range of the active light beam corresponds to the ejection position of ink which has relatively low sensitivity with respect to the active light beam and which has a slow curing speed, then abnormalities due to differences in the curing sensitivity between inks can be avoided.

For this mode, the first direction may be called the main scanning direction and the second direction may be called the sub-scanning direction.

Desirably, the irradiation light amount variation device moves the active light beam irradiation device in such a manner that an irradiation range of the active light beam irradiation device corresponds to an ejection position of the ink which has relatively low sensitivity with respect to the active light beam and has a slow curing speed.

According to this mode, it is possible to irradiate a desirable active light beam which corresponds to the curing characteristics of the ink, by appropriately moving the active light beam irradiation device.

Desirably, the irradiation light amount variation device automatically moves the active light beam irradiation device in accordance with a layer formation mode specifying the inks used in the layers constituting the image and number of the layers, when the layer formation mode is switched.

According to this mode, irradiation of a desirable active light beam corresponding to the layer formation mode can be achieved.

Desirably, the active light beam irradiation device includes a light source which emits the active light beam and which is configured in form of a cartridge; and the irradiation light amount variation device includes a light source accommodation unit configured so as to be able to accommodate the light source at a position corresponding to a divided unit of the nozzle rows, in an outside of the nozzle rows in the first direction.

According to this mode, it is possible to arrange a light source in the form of a cartridge so as to correspond to the curing characteristics of the ink, and therefore desirable irradiation of an active light beam can be achieved.

In this mode, it is possible to provide a reporting device which determines the position of the light source and issues a report (information) in order to move the cartridge (light source) on the basis of the determination results.

Desirably, the irradiation light amount variation device controls an irradiation amount of the active light beam in accordance with the curing characteristics of the inks in such a manner that the irradiation light amount of the active light beam irradiated from the active light beam irradiation device is relatively greater at an ejection position of the ink which has relatively low sensitivity with respect to the active light beam and has a slow curing speed than at an ejection position of another ink.

According to this mode, since the irradiation range of the active light beam is divided in accordance with the divided units of the nozzle rows and the irradiation light amount can be varied for each divided unit, then it is possible to achieve optimal irradiation of an active light beam onto the ejection position of ink which has relatively low sensitivity with respect to the active light beam and which has a slow curing speed and onto the ejection position of ink which has relatively high sensitivity with respect to the active light beam and which has a fast curing speed.

Desirably, the irradiation light amount variation device is capable of performing any one of electric current value control, pulse width modulation control and on/off control so as to vary the amount of the irradiation light of the active light beam irradiated from the active light beam irradiation device.

In this mode, it is possible to provide any one of a current control device which controls the current value, a pulse width modulation control device which performs pulse width modulation control, or an on/off control device which performs on/off control.

Desirably, the active light beam irradiation device has a structure in which ultraviolet LED elements are aligned in the second direction so as to correspond to the divided units of the nozzle rows; and the irradiation light amount variation device controls light emission by the ultraviolet LED elements in accordance with difference in sensitivity with respect to the active light beam of the inks ejected from the divided units of the nozzle rows.

According to this mode, it is possible to control light emission by the ultraviolet LED elements individually, and an optimal active light beam can be irradiated onto the ejection positions of the respective inks, in accordance with the ink curing characteristics.

Desirably, the irradiation light amount variation device is capable of automatically changing an irradiation light amount of the ultraviolet LED elements in accordance with a layer formation mode specifying the inks used in the layers constituting the image and number of the layers in such a manner that when the layer formation mode is switched, an irradiation range of the active light beam irradiation device corresponds to an ejection position of the ink which has relatively low sensitivity with respect to the active light beam and has a slow curing speed.

According to this mode, desirable image formation is achieved in accordance with the layer formation mode.

Desirably, a length of an irradiation range of the active light beam irradiation device in the second direction is not greater than a value obtained by dividing a total length of the nozzle rows in the second direction by number of the divided units of the nozzle rows.

According to this mode, irradiation of an active light beam onto unwanted regions is prevented.

In this mode, if the total length of the nozzle rows in the second direction is represented as $L_w$ and if the number of divisions of the nozzle rows is N, then the irradiation range of the active light beam irradiation device in the second direction is not more than $L_w/N$.

Desirably, number of the divided units of the nozzle rows is equal to number of the layers of an image formed on the recording medium.

In this mode, when an image comprising two layers is formed, the nozzle rows are divided into an upstream region and a downstream region in the second direction. For example, if ink which has a relatively high sensitivity with respect to the active light beam and which has a fast curing speed is ejected from an upstream region of the first nozzle row and ink which has a relatively low sensitivity with respect to the active light beam and which has a slow curing speed is ejected from a downstream region of the second nozzle row, the active light beam irradiation device is moved in such a manner that the irradiation range of the active light beam irradiation device corresponds to the downstream region of the second nozzle row, and a layer formed by ink having a relatively low sensitivity with respect to the active light beam and a slow curing speed is layered on top of a layer formed by ink having a relatively high sensitivity with respect to the active light beam and a fast curing speed.

Desirably, the second relative movement device relatively conveys the image forming device and the recording medium intermittently in one direction, by setting as an amount of conveyance in one conveyance action a length obtained by dividing a length in the second direction of the divided units of the nozzle rows by number of multiple passes, the number of multiple passes being determined by multiplication of a value obtained by dividing an arrangement pitch of the nozzle rows in the first direction by a minimum dot pitch in the first direction, and a value obtained by dividing a nozzle arrangement pitch in the second direction by a minimum dot pitch in the second direction.

According to this mode, it is possible to form an image in which a plurality of layers are superimposed on each other, without the recording medium and the image forming device performing a reciprocal movement.

Desirably, the active light beam irradiation device includes a provisional curing device which is provided outside the nozzle rows in the first direction, has an irradiation range in the second direction of a length corresponding to a total length of the nozzle rows in the second direction, and provisionally cures the ink that has been deposited on the recording medium.

According to this mode, landing interference between ink droplets which are deposited on adjacent positions is prevented by provisionally curing the ink. Furthermore, it is possible to spread the ink droplets to a prescribed size by maintaining a provisionally cured state for a prescribed period of time, and the height (thickness) of the ink droplets is made uniform. Moreover, a prescribed adhesion between the recording medium or other layers can be guaranteed.

Here, "provisional curing" in this mode is a state where the ink droplets are cured to an extent which prevents movement of the ink droplets on the recording medium. The irradiation energy from the provisional curing device is desirably approximately 1/250 of the energy irradiated onto the ink which has relatively low sensitivity with respect to the active light beam and which has a slow curing speed.

Desirably, the active light beam irradiation device includes main curing devices which are provided on both sides of the nozzle rows in the first direction in a downstream side of the nozzle rows in the second direction, and which fully cure the ink that has been provisionally cured by the provisional curing device; and either one of the main curing devices provided on both sides of the nozzle rows irradiates the active light beam onto the ejection position of the ink which has relatively low sensitivity with respect to the active light beam and has a slow curing speed.

According to this mode, by combining a main curing device which fully cures the ink droplets and a device which irradiates an active light beam onto ink which has low sensitivity with respect to the active light beam and has a slow curing speed, a contribution is made to the simplification and compactification of the composition of the image forming device.

In this mode, "full curing" is a state where the ink droplets on the recording medium have been completely cured.

In this mode, the energy of the active light beam per movement operation in the first direction which is irradiated from the main curing device in this mode can be made the same as the energy per movement operation in the first direction which is irradiated onto the ink having a relatively low sensitivity with respect to the active light beam and a slow curing speed.

Desirably, the main curing light sources have an irradiation range of a prescribed length in the first direction, and are configured in such a manner that the irradiation range can be divided in accordance with a length in the second direction of the divided units of the nozzle rows; and the irradiation light amount variation device causes the main curing light sources to move in the first direction, and rotates the main curing light sources in a plane parallel to a surface where the nozzles are formed, so as to irradiate the active light beam onto the ejection position of the ink which has relatively low sensitivity with respect to the active light beam and has a slow curing speed.

Desirably, the image forming device includes a color ink nozzle row from which color ink for forming a color image is ejected, and a white ink nozzle row from which white ink which has relatively lower sensitivity with respect to the active light beam and which has a slower curing speed than the color ink, is ejected; and the irradiation light amount variation device controls irradiation of the active light beam by the active light beam irradiation device, in such a manner that an irradiation light amount onto an ejection position of the white ink is greater than an irradiation light amount onto an ejection position of the color ink.

The "white ink" in this mode includes ink which has low sensitivity with respect to the active light beam and a slow curing speed, such as ink containing titanium oxide as a pigment, or ink having a reduced content of initiator.

Furthermore, examples of the color ink can include color inks such as cyan, magenta, and yellow inks, and light inks and dark inks of these colors.

Desirably, the irradiation light amount variation device controls the irradiation of the active light beam by the active light beam irradiation device in such a manner that an irradiation energy onto the ejection position of the white ink per movement operation in the first direction is not less than two times an irradiation energy onto the ejection position of the color ink per movement operation in the first direction when the color ink is provisionally cured.

In this mode, the irradiation energy onto the ejection position of the white ink per movement operation in the first direction is desirably not less than 10 times the irradiation energy onto the ejection position of the color ink per movement operation in the first direction when provisionally curing the color ink.

In a specific example of this mode, the energy per movement in the first direction when provisionally curing the color ink is 1 to 5 $mJ/cm^2$, and the energy per movement in the first direction which is irradiated onto the white ink is not less than 10 $mJ/cm^2$.

Desirably, the irradiation light amount variation device is capable of changing the irradiation light amount of the active light beam by the active light beam irradiation device in such a manner that an irradiation energy onto the ejection position of the white ink per movement operation in the first direction is substantially equal to an irradiation energy onto the ejection position of the color ink per movement operation in the first direction when the color ink is fully cured.

In a specific example of this mode, the energy when fully curing the color ink and the energy per movement in the first direction which is irradiated onto the white ink are not less than 10 $mJ/cm^2$.

Desirably, the ejection control device controls the ink ejection by the image forming device so as to form on the recording medium a white base layer by the white ink and to form a color image layer by the color ink on top of the white base layer.

The white ink which forms the white base layer (the image forming the underlayer of the color image layer) is a so-called solid image, and therefore it can be cured completely without preventing landing interference, ensuring time for the ink droplets to spread or ensuring time for the height of the ink droplets to become uniform.

On the other hand, a desirable mode is one in which, when forming the color image layer, the color ink is cured provisionally and the color ink is fully cured after a prescribed time period has elapsed.

Desirably, the ejection control device controls the ink ejection by the image forming device so as to form on a transparent or semi-transparent recording medium a color image layer by the color ink, and to form a white base layer by the white ink on top of the color image layer.

In this mode, desirably, when forming a color image layer, the color ink is provisionally cured and after a prescribed time period has elapsed, white ink is ejected onto the provisionally cured color ink, and the color ink and the white ink are fully cured at the same time.

Desirably, the ejection control device controls the ink ejection by the image forming device so as to form on the recording medium a white base layer by the white ink, to form a color image layer by the color ink on top of the white base layer, and to form a white base layer by the white ink on top of the color image layer.

In this mode, desirably, when forming a color image layer, the color ink is provisionally cured and after a prescribed time period has elapsed, white ink is ejected onto the provisionally cured color ink and the color ink and the white ink are fully cured at the same time, whereupon color ink is ejected onto the white base layer, the color ink is provisionally cured, and the color ink is then fully cured after a prescribed time period has elapsed.

Desirably, the image forming device includes a clear nozzle row which ejects clear ink; and the irradiation light amount variation device is capable of changing the amount of the irradiation light of the active light beam by the active light beam irradiation device in such a manner that an irradiation energy onto an ejection position of the clear ink per movement operation in the first direction is substantially equal to an irradiation energy onto an ejection position of color ink per movement operation in the first direction.

In a specific example of the irradiation energy, the energy per movement in the first direction when provisionally curing the color ink and the clear ink is 1 to 5 $mJ/cm^2$, and the energy per movement in the first direction during main curing is not less than 10 $mJ/cm^2$.

Desirably, the ejection control device controls the ink ejection by the image forming device so as to form on the recording medium a color image layer by the color ink, and to form a transparent layer by the clear ink on top of the color image layer.

In this mode, desirably, both the color ink and the clear ink are provisionally cured, and are then fully cured after a prescribed period of time has elapsed.

Desirably, the image forming device includes an inkjet head having the nozzle rows to correspond to the inks having different curing characteristics.

Desirably, the image forming device includes inkjet heads having the nozzle rows to correspond to the inks having different curing characteristics, the inkjet heads being provided for the inks respectively.

Another aspect of the invention is directed to an image forming method comprising: an ink ejection step of ejecting inks which are curable by irradiation of an active light beam with respect to each of units obtained by dividing a nozzle row in which nozzles are arranged into units while causing relative movement between the nozzle row and a recording medium, the inks with different curing characteristics being ejected from different nozzle rows so as to form layers on the recording medium by the inks ejected from the divided units of the nozzle rows in such a manner that the layers formed by the inks ejected from different divided units are mutually superimposed; and an active light beam irradiation step of adjusting an irradiation light amount from the active light beam irradiation device in accordance with the curing characteristics of the inks constituting the layers formed on the recording medium.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

an image forming device including nozzle rows which are provided to correspond to inks that are curable by irradiation of an active light beam and have different curing characteristics respectively, and which have nozzles arranged for ejecting the inks;

a relative movement device which causes relative movement between the nozzle rows and a recording medium on which the inks ejected from the nozzles are deposited;

an ejection control device which controls ink ejection from the image forming device with respect to each of divided units obtained by dividing the nozzle rows into a plurality of units, so as to form layers on the recording medium by the inks ejected from the respective divided units in such a manner that the layers that are formed by the inks ejected from the different divided units are superimposed on each other;

an active light beam irradiation device which irradiates the active light beam onto the inks that have been ejected onto the recording medium; and an irradiation light amount variation device which is capable of varying an amount of irradiation light from the active light beam irradiation device, in accordance with the curing characteristics of the inks in the respective layers on the recording medium, wherein the irradiation light amount variation device moves the active light beam irradiation device in such a manner that an irradiation range of the active light beam irradiation device corresponds to an ejection position of the ink which has relatively low sensitivity with respect to the active light beam and has a slow curing speed.

2. The inkjet recording apparatus as defined in claim 1, wherein the irradiation light amount variation device automatically moves the active light beam irradiation device in accordance with a layer formation mode specifying the inks used in the layers constituting an image and number of the layers, when the layer formation mode is switched.

3. The inkjet recording apparatus as defined in claim 1, wherein:

the active light beam irradiation device includes a light source which emits the active light beam and which is configured in form of a cartridge; and the irradiation light amount variation device includes a light source accommodation unit configured so as to be able to accommodate the light source at a position corresponding to a divided unit of the nozzle rows, in an outside of the nozzle rows in the first direction.

4. The inkjet recording apparatus as defined in claim 1, wherein the irradiation light amount variation device controls an irradiation amount of the active light beam in accordance with the curing characteristics of the inks in such a manner that the irradiation light amount of the active light beam irradiated from the active light beam irradiation device is relatively greater at an ejection position of the ink which has relatively low sensitivity with respect to the active light beam and has a slow curing speed than at an ejection position of another ink.

5. The inkjet recording apparatus as defined in claim 4, wherein the irradiation light amount variation device is capable of performing any one of electric current value control, pulse width modulation control and on/off control so as to vary the amount of the irradiation light of the active light beam irradiated from the active light beam irradiation device.

6. The inkjet recording apparatus as defined in claim 5, wherein:

the active light beam irradiation device has a structure in which ultraviolet LED elements are aligned in the second direction so as to correspond to the divided units of the nozzle rows; and the irradiation light amount variation device controls light emission by the ultraviolet LED elements in accordance with difference in sensitivity with respect to the active light beam of the inks ejected from the divided units of the nozzle rows.

7. The inkjet recording apparatus as defined in claim 6, wherein the irradiation light amount variation device is capable of automatically changing an irradiation light amount of the ultraviolet LED elements in accordance with a layer formation mode specifying the inks used in the layers constituting the image and number of the layers in such a manner that when the layer formation mode is switched, an irradiation range of the active light beam irradiation device corresponds to an ejection position of the ink which has relatively low sensitivity with respect to the active light beam and has a slow curing speed.

8. The inkjet recording apparatus as defined in claim 1, wherein a length of an irradiation range of the active light beam irradiation device in the second direction is not greater than a value obtained by dividing a total length of the nozzle rows in the second direction by number of the divided units of the nozzle rows.

9. The inkjet recording apparatus as defined in claim 1, wherein number of the divided units of the nozzle rows is equal to number of the layers of an image formed on the recording medium.

10. The inkjet recording apparatus as defined in claim 1, wherein the image forming device includes a color ink nozzle row from which color ink for forming a color image is ejected, and a white ink nozzle row from which white ink which has relatively lower sensitivity with respect to the active light beam and which has a slower curing speed than the color ink, is ejected; and the irradiation light amount variation device controls irradiation of the active light beam by the active light beam irradiation device, in such a manner that an irradiation light amount onto an ejection position of the white ink is greater than an irradiation light amount onto an ejection position of the color ink.

11. The inkjet recording apparatus as defined in claim 10, wherein the irradiation light amount variation device controls the irradiation of the active light beam by the active light beam irradiation device in such a manner that an irradiation energy onto the ejection position of the white ink per movement operation in the first direction is not less than two times an irradiation energy onto the ejection position of the color ink per movement operation in the first direction when the color ink is provisionally cured.

12. The inkjet recording apparatus as defined in claim 10, wherein the irradiation light amount variation device is capable of changing the irradiation light amount of the active light beam by the active light beam irradiation device in such a manner that an irradiation energy onto the ejection position of the white ink per movement operation in the first direction is substantially equal to an irradiation energy onto the ejection position of the color ink per movement operation in the first direction when the color ink is fully cured.

13. The inkjet recording apparatus as defined in claim 10, wherein the ejection control device controls the ink ejection by the image forming device so as to form on the recording medium a white base layer by the white ink and to form a color image layer by the color ink on top of the white base layer.

14. The inkjet recording apparatus as defined in claim 10, wherein the ejection control device controls the ink ejection by the image forming device so as to form on the recording medium a color layer by the color ink, to form a white base image layer by the white ink on top of the color layer, and to form a color layer by the color ink on top of the white image layer.

15. An inkjet recording apparatus comprising:

an image forming device including nozzle rows which are provided to correspond to inks that are curable by irradiation of an active light beam and have different curing characteristics respectively, and which have nozzles arranged for ejecting the inks;

a relative movement device which causes relative movement between the nozzle rows and a recording medium on which the inks ejected from the nozzles are deposited;

an ejection control device which controls ink ejection from the image forming device with respect to each of divided units obtained by dividing the nozzle rows into a plurality of units, so as to form layers on the recording medium by the inks ejected from the respective divided units in such a manner that the layers that are formed by the inks ejected from the different divided units are superimposed on each other;

an active light beam irradiation device which irradiates the active light beam onto the inks that have been ejected onto the recording medium; and an irradiation light amount variation device which is capable of varying an amount of irradiation light from the active light beam irradiation device, in accordance with the curing characteristics of the inks in the respective layers on the recording medium, wherein the relative movement device includes: a first relative movement device which causes relative movement between the image forming device and the recording medium in a first direction along a direction of arrangement of the nozzle rows; and a second relative movement device which causes relative movement between the image forming device and the recording medium in a second direction which is perpendicular to the first direction, and the irradiation light amount variation device causes movement in the second direction in an outside of the nozzle rows in the first direction, in accordance with the curing characteristics of the inks in such a manner that an irradiation range of the active light beam irradiation device corresponds to an ejection position of the ink which has relatively low sensitivity with respect to the active light beam and has a slow curing speed, wherein the active light beam irradiation device includes a provisional curing device which is provided outside the nozzle rows in the first direction, has an irradiation range in the second direction of a length corresponding to a total length of the nozzle rows in the second direction, and provisionally cures the ink that has been deposited on the recording medium, wherein the active light beam irradiation device includes main curing devices which are provided on both sides of the nozzle rows in the first direction in a downstream side of the nozzle rows in the second direction, and which fully cure the ink that has been provisionally cured by the provisional curing device; and either one of the main curing devices provided on both sides of the nozzle rows irradiates the active light beam onto the ejection position of the ink which has relatively low sensitivity with respect to the active light beam and has a slow curing speed.

16. The inkjet recording apparatus as defined in claim 15, wherein the second relative movement device relatively conveys the image forming device and the recording medium intermittently in one direction, by setting as an amount of conveyance in one conveyance action a length obtained by dividing a length in the second direction of the divided units of the nozzle rows by number of multiple passes, the number of multiple passes being determined by multiplication of a value obtained by dividing an arrangement pitch of the nozzle rows in the first direction by a minimum dot pitch in the first direction, and a value obtained by dividing a nozzle arrangement pitch in the second direction by a minimum dot pitch in the second direction.

17. The inkjet recording apparatus as defined in claim 15, wherein:

the main curing means have an irradiation range of a prescribed length in the first direction, and are configured in such a manner that the irradiation range can be divided in accordance with a length in the second direction of the divided units of the nozzle rows; and the irradiation light amount variation device causes the main curing means to move in the first direction, and rotates the main curing means in a plane parallel to a surface where the nozzles are formed, so as to irradiate the active light beam onto the ejection position of the ink which has relatively low sensitivity with respect to the active light beam and has a slow curing speed.

18. An image forming method comprising:

an ink ejection step of ejecting inks which are curable by irradiation of an active light beam with respect to each of units obtained by dividing a nozzle row in which nozzles are arranged into units while causing relative movement between the nozzle row and a recording medium, the inks with different curing characteristics being ejected from different nozzle rows so as to form layers on the recording medium by the inks ejected from the divided units of the nozzle rows in such a manner that the layers formed by the inks ejected from different divided units are mutually superimposed; and an active light beam irradiation step of adjusting an irradiation light amount from the active light beam irradiation device in accordance with the curing characteristics of the inks constituting the layers formed on the recording medium, wherein the irradiation light amount variation device moves the active light beam irradiation device in such a manner that an irradiation range of the active light beam irradiation device corresponds to an ejection position of the ink which has relatively low sensitivity with respect to the active light beam and has a slow curing speed.

19. An image forming method comprising:

an ink ejection step of ejecting inks which are curable by irradiation of an active light beam with respect to each of units obtained by dividing a nozzle row in which nozzles are arranged into units while causing relative movement between the nozzle row and a recording medium, the inks with different curing characteristics being ejected from different nozzle rows so as to form layers on the recording medium by the inks ejected from the divided units of the nozzle rows in such a manner that the layers formed by the inks ejected from different divided units are mutually superimposed; and an active light beam irradiation step of adjusting an irradiation light amount from the active light beam irradiation device in accordance with the curing characteristics of the inks constituting the layers formed on the recording medium, wherein the relative movement device includes: a first relative movement device which causes relative movement between the image forming device and the recording medium in a first direction along a direction of arrangement of the nozzle rows; and a second relative movement device which causes relative movement between the image forming device and the recording medium in a second direction which is perpendicular to the first direction, and the irradiation light amount variation device causes movement in the second direction in an outside of the nozzle rows in the first direction, in accordance with the curing characteristics of the inks in such a manner that an irradiation range of the active light beam irradiation device corresponds to an ejection position of the ink which has relatively low sensitivity with respect to the active light beam and has a slow curing speed, wherein the active light beam irradiation device includes a provisional curing device which is provided outside the nozzle rows in the first direction, has an irradiation range in the second direction of a length corresponding to a total length of the nozzle rows in the second direction, and provisionally cures the ink that has been deposited on the recording medium, wherein the active light beam irradiation device includes main curing devices which are provided on both sides of the nozzle rows in the first direction in a downstream side of the nozzle rows in the second direction, and which fully cure the ink that has been provisionally cured by the provisional curing device; and either one of the main curing devices provided on both sides of the nozzle rows irradiates the active light beam onto the ejection position of the ink which has relatively low sensitivity with respect to the active light beam and has a slow curing speed.

* * * * *